US010674582B1

(12) United States Patent
Ramer et al.

(10) Patent No.: US 10,674,582 B1
(45) Date of Patent: Jun. 2, 2020

(54) ADAPTIVE SURFACE ILLUMINATION

(71) Applicant: ABL IP HOLDING LLC, Conyers, GA (US)

(72) Inventors: David P. Ramer, Reston, VA (US); Forrest McCanless, Oxford, GA (US); Januk Aggarwal, Alexandria, VA (US)

(73) Assignee: ABL IP HOLDING LLC, Conyers, GA (US)

( * ) Notice: Subject to any disclaimer, the term of this patent is extended or adjusted under 35 U.S.C. 154(b) by 0 days.

(21) Appl. No.: 16/192,022

(22) Filed: Nov. 15, 2018

(51) Int. Cl.
*H05B 37/02* (2006.01)
*H05B 45/00* (2020.01)
(Continued)

(52) U.S. Cl.
CPC ..... *H05B 45/22* (2020.01); *F21K 9/62* (2016.08); *F21K 9/64* (2016.08); *F21V 7/0025* (2013.01);
(Continued)

(58) Field of Classification Search
CPC ..... F21Y 2115/10; F21Y 2103/10; F21Y 2105/10; F21Y 2113/00; F21Y 2105/12; F21S 8/04; F21S 8/026; F21S 4/28; F21S 4/20; F21V 5/04; F21V 5/007; F21V 5/046; F21V 7/0025; F21V 23/003; F21V 7/0091; F21V 23/0435; F21V 23/0442; F21V 14/00; F21V 23/008; F21V 23/0471; F21V 5/043; F21V 5/045; F21V 7/0083; H05B 33/0854; H05B 33/0845; H05B 33/0857; H05B 37/0272; H05B 33/0872; H05B 33/0896; H05B 37/02; H05B 37/0218;
(Continued)

(56) References Cited

U.S. PATENT DOCUMENTS 9,198,262 B1 * 11/2015 Bosua ..... H05B 33/0845
9,210,779 B2 * 12/2015 Bosua ..... H05B 37/0245
(Continued)

FOREIGN PATENT DOCUMENTS

DE 102012201494 A1 8/2012

OTHER PUBLICATIONS

Linda Trego, "Osram's hybrid LED combines light-emitting chip and individual pixel control," Autonomous Vehicle Technology, Sep. 26, 2017 (2 pages).
(Continued)

*Primary Examiner* — Vibol Tan
(74) *Attorney, Agent, or Firm* — RatnerPrestia

(57) ABSTRACT

A lighting system or method adaptively illuminates a face of an architectural panel. An example illumination system includes an optic and a pixel controllable array of solid state light emitters. When installed, the optic is aimed with its optical axis at an acute angle relative to a face of the panel. The array is coupled to selectively emit light from emitters at pixels of the array through the optic toward different regions of the face of the architectural panel. A controller is coupled to control the individual light emitters, via a driver of the emitters. The controller controls the emitters of the array so as to selectively control output intensity of the light emitters when emitting light through the optic toward selected regions of the face of the architectural panel, so as to adaptively illuminate surface topology features of the face of the architectural panel.

18 Claims, 14 Drawing Sheets

(51) Int. Cl.

| | |
|---|---|
| ***F21V 23/00*** | (2015.01) |
| ***H05B 45/22*** | (2020.01) |
| ***F21K 9/62*** | (2016.01) |
| ***F21K 9/64*** | (2016.01) |
| ***H05B 47/19*** | (2020.01) |
| ***H05B 45/10*** | (2020.01) |
| ***H05B 47/10*** | (2020.01) |
| ***F21V 7/00*** | (2006.01) |

(52) U.S. Cl.
CPC ..... *F21V 7/0083* (2013.01); *F21V 23/003* (2013.01); *H05B 45/00* (2020.01); *H05B 45/10* (2020.01); *H05B 47/10* (2020.01); *H05B 47/19* (2020.01)

(58) Field of Classification Search
CPC ..... H05B 33/0842; H05B 33/0869; H05B 45/10; H05B 45/20; H05B 47/19; H05B 45/00; H05B 47/10; H05B 47/175; Y02B 20/48; Y02B 20/44; G02B 27/0955; Y10S 362/80; F21K 9/64; F21K 9/62
See application file for complete search history.

(56) References Cited

U.S. PATENT DOCUMENTS

| | | | | |
|---|---|---|---|---|
| 9,347,642 | B2 | 5/2016 | Catalano | |
| 9,464,767 | B2 * | 10/2016 | Whitfield | F21V 27/005 |
| 9,470,406 | B2 | 10/2016 | Catalano | |
| 9,635,737 | B2 * | 4/2017 | Bosua | H05B 33/0845 |
| 9,658,438 | B2 * | 5/2017 | Forrester | G02B 19/0042 |
| 9,883,563 | B2 * | 1/2018 | Bosua | H05B 33/0845 |
| 9,936,566 | B2 * | 4/2018 | Alexander | H05B 37/0245 |
| 10,136,490 | B1 * | 11/2018 | Mao | H05B 33/0845 |
| 10,139,077 | B2 * | 11/2018 | Kang | G02B 19/0014 |
| 10,190,746 | B1 * | 1/2019 | Mao | F21V 23/04 |
| 10,215,391 | B2 * | 2/2019 | Newton | F21S 8/026 |
| 10,267,486 | B1 | 4/2019 | Mao et al. | |
| 2013/0058103 | A1 | 3/2013 | Jiang et al. | |
| 2014/0036511 | A1 * | 2/2014 | Whitfield | F21V 27/005 362/311.02 |
| 2014/0084809 | A1 | 3/2014 | Catalano | |
| 2016/0258588 | A1 | 9/2016 | Grötsch et al. | |
| 2017/0018215 | A1 * | 1/2017 | Black | G09G 3/02 |
| 2017/0153004 | A1 * | 6/2017 | De Zwart | F21V 5/007 |
| 2017/0160528 | A1 * | 6/2017 | Liu | G02B 19/0042 |
| 2017/0175987 | A1 * | 6/2017 | Newton | F21S 8/026 |
| 2018/0073686 | A1 | 3/2018 | Quilici et al. | |
| 2019/0235257 | A1 | 8/2019 | Mao et al. | |

OTHER PUBLICATIONS

LBC Lighting, "Wall Wash Lighting & Wall Graze Lighting Techniques," Blog Search Article downloaded from https://www.lbclighting.com/blog/2016/05/wall-wash-lighting/, May 27, 2016 (7 pages).
Chris Stobing, "Short Throw vs. Long Throw Projectors: What's the Difference?", Gadget Review, updated Apr. 10, 2018 (12 pages).
Elizabeth Donoff, "Wallwashing and Wall Grazing," Architectural Lighting, posted on Sep. 3, 2015 (5 pages).
JEDI—Targetti, "JEDI Series," downloaded from http://targettiusa.net/outdoor/jedi/, Jul. 5, 2018 (5 pages).
U.S. Appl. No. 15/868,624, entitled "Optical Lens for Beam Shaping and Steering and Devices Using the Optical Lens," filed Jan. 11, 2018 (72 pages).
U.S. Appl. No. 15/914,619, entitled "Lighting Device With Optical Lens and Beam Pattern Adjustment Using the Optical Lens With Driving Techniques," filed Mar. 7, 2018 (94 pages).
U.S. Appl. No. 15/924,868, entitled "Lighting Device With Optical Lens for Beam Shaping and Illumination Light Source Matrix," filed Mar. 19, 2018 (118 pages).

* cited by examiner

100
Image Sensor(s) (e.g. Camera(s))
121
Controller
114
Host Proc. System
115
μProc.
123
Ports - Interfaces
129
Memories/Storage
125
RAM
ROM
Program(s)
127
Communication Interface(s)
117
User
Other Control
Other Comm
Matrix Driver (Pixel Light Generation Control)
113
High-Resolution, Pixel Controllable Array of Solid State Light Emitters
111
Optic
110

ADAPTIVE SURFACE ILLUMINATION

TECHNICAL FIELD

The present subject matter relates to techniques and equipment to enable adaptive control of light emissions for illumination of a surface, for example, for wall grazing or wall wash applications.

BACKGROUND

A wall wash is a type of light fixture, which is mounted to a ceiling and intended to direct light to the face of a wall near the fixture in a uniform manner to substantially eliminate shadows or other variations in intensity or shading across the illuminated surface of the wall. Ideally, light would be distributed evenly on the wall with the light directed close to the ceiling and a smooth transition down the face of the wall toward the floor. Such lighting, for example, may emphasize smoothness of the illuminated surface. Variations in surface texture, however, may disrupt the apparent uniformity by creating light and dark regions on the illuminated surface of the wall due to shadow effects of projecting features and the angle of light from the wall wash fixture.

A grazing application similarly uses a light fixture mounted to a ceiling intended to direct light to the face of a wall near the fixture. The grazing light fixture typically is mounted nearer the illuminated face of the wall and aimed to output light around an axis at a smaller angle relative to the wall face. Rather than emphasizing surface uniformity, such a grazing light fixture emphasizes texture by creating light and dark regions due to shadow effects of intentional design features of a textured surface on the face of the wall. Grazing, however, may also create undesired light and dark regions when portions of the surface that should be uniform are not uniform due to surface imperfections. A grazing light, however, may even be used to detect imperfections for corrections, for example, to allow a builder to detect and sand out or otherwise remove imperfections in a wall during construction.

Light fixtures for wall washing and grazing applications traditionally have relatively static light distributions specifically designed for the particular application. In either case, the fixture is mounted at a particular location and any adjustable components of the light fixture (e.g. relating to angle of emission toward the surface of the wall) are set during installation so as to provide the intended direction and range of angular distribution for the washing or grazing of the particular architectural panel. Once mounted and configured, the distribution remains unchanged unless a technician manually adjusts the fixture. Other than some minor manual adjustment, there is no practical technique to adjust the output distribution of light from the fixture, for example, to compensate for imperfections in the illuminated wall surface.

SUMMARY

Hence, a need exists for adaptive control of light emissions for illumination of a surface, for example, for wall grazing or wall wash applications. In a wall wash or grazing, example, adaptive control may enable compensation for undesirable variations in light and dark regions due to imperfections in the illuminated architectural surface. For grazing or similar surface illumination applications, it may sometimes be desirable to increase variations in light and dark regions due to deliberately provided textural features of the illuminated architectural surface or to deliberately detect surface irregularities or imperfections. Hence, the concepts disclosed herein improve illumination of a face of an architectural panel by utilizing a pixel controllable array of solid state light emitters and circuitry for adaptive control of the emitters of the array. For example, this technique may adaptively illuminate features a face of a wall or other architectural panel by selectively activating ones of the light emitters of the array.

An example of a lighting system for illuminating a face of an architectural panel includes an optic and a pixel controllable array of solid state light emitters. The optic is configured to be aimed to have an optical axis at an acute angle relative to a face of the architectural panel. The pixel controllable array of solid state light emitters is coupled to selectively emit light from emitters at pixels of the array through the optic toward different regions of the face of the architectural panel. The example also includes a driver coupled to selectively drive individual light emitters at pixels of the array. A controller is coupled to control the individual light emitters, via the driver. The controller is configured to control the emitters of the array so as to selectively control output intensity of a plurality of the light emitters emitting light through the optic to one or more selected regions of the face of the architectural panel, so as to adaptively illuminate surface topology features of the face of the architectural panel.

An example method for illuminating a face of an architectural panel involves directing light output from a pixel controllable array of solid state light emitters to illuminate an area of the face of the architectural panel, at an acute angle relative to the face of the architectural panel; and capturing an image of the illuminated area of the face of the architectural panel. Regions within the illuminated area of the face having relatively brighter and darker illumination are identified. The differences in illumination, for example, may be caused by angled illumination of topological features of the surface of the face of the panel, from processing of data of the captured image. The method also entails selectively changing output intensity of one or more of the light emitters of the array to change intensity of illumination of one or more of the identified regions and adjust relative intensity of illumination among the regions of the illuminated area of the face of the architectural panel.

Additional objects, advantages and novel features of the examples will be set forth in part in the description which follows, and in part will become apparent to those skilled in the art upon examination of the following and the accompanying drawings or may be learned by production or operation of the examples. The objects and advantages of the present subject matter may be realized and attained by means of the methodologies, instrumentalities and combinations particularly pointed out in the appended claims.

BRIEF DESCRIPTION OF THE DRAWINGS

The drawing figures depict one or more implementations, by way of example only, not by way of limitations. In the figures, like reference numerals refer to the same or similar elements.

DETAILED DESCRIPTION

Figure 1:
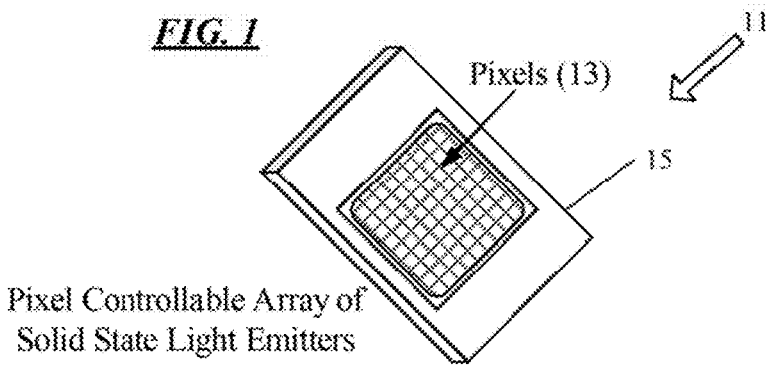
FIG. 1 is an isometric view of an example of a pixel controllable array of solid state light emitters.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

The various examples disclosed herein relate to a lighting system or method to adaptively illuminate a surface. In the examples, the surface is that of a face of an architectural panel.

The face of the panel, for example, would be the area of the panel facing into a room or other space illuminated by the system. The face of the architectural panel has one or more associated planes. If the face was a perfectly flat surface, for example, then a plane would be coincident with the face of the architectural panel. In many examples of adaptive surface illumination, whether the face is relatively flat or is curved or otherwise non-flat, the face of the architectural panel is not a perfectly smooth surface. Instead, the face of the panel may include any of various types of surface topology features that produce differences in depth (topographical deviations) from the ideal macro-contour of the surface. For example, for a vertical wall, the plane would be vertical. For a horizontal panel, such as a ceiling, floor or countertop, the plane would be horizontal. The surface topology features of the face of the relatively flat example architectural panel (i.e. the actual surface) vary in depth from the plane (i.e. the ideal planar contour in the vertical or horizontal panel type examples). For example, such surface topology features may be smaller scale contours deliberately formed on the face of the panel to create an apparent texture, or the surface topology features may be unintended surface irregularities or imperfections.

Many of the examples relate to panels with faces having relatively flat contours, such as walls, ceilings, floors or countertops. The systems and methods disclosed herein, however, may be adapted to illumination of panels with contours of other non-flat types. If the face is not a flat contoured surface, for example, if the face has a curved or faceted large scale (macro) surface contour, then the face would have associated tangential planes at each point of the intended or ideal contour of the face of the panel. Examples of architectural panels with curved or faceted contours include domes or other types of vaulted ceilings as well as columns of various shapes.

An example of an illumination system for such an application includes an optic and a pixel controllable array of solid state light emitters. When installed, the optic is aimed to have its optical axis at an acute angle relative to a plane of the face of the architectural panel. The pixel controllable array of solid state light emitters is coupled to selectively emit light from emitters at pixels of the array through the optic toward different regions of the face of the architectural panel. The example system also includes a driver coupled to selectively drive individual light emitters at pixels of the array. A controller is coupled to control the individual light emitters, via the driver. The controller is configured to control the emitters of the array so as to selectively control output intensity of the light emitters emitting light through the optic toward selected regions of the face of the architectural panel, so as to adaptively illuminate surface topology features of the face of the architectural panel.

The term "luminaire," as used herein, is intended to encompass essentially any type of device that processes energy to generate or supply artificial light, for example, for general illumination of a space intended for use of occupancy or observation, typically by a living organism that can take advantage of or be affected in some desired manner by the light emitted from the device. Other application examples include providing light for highlighting a wall or the like that bears information (e.g. signage or a billboard), which may be read or otherwise observed by a person. However, a luminaire may provide light for use by automated equipment, such as sensors/monitors, robots, etc. that may occupy or observe the illuminated space, instead of or in addition to light provided for an organism. However, it is also possible that one or more luminaires in or on a particular premises have other lighting purposes, such as signage for an entrance or to indicate an exit. In most examples, the luminaire(s) illuminate a space or area of a premises to a level useful for a human in or passing through the space, e.g. general illumination of a room or corridor in a building or of an outdoor space such as a street, sidewalk, parking lot or performance venue. The actual source of illumination light in or supplying the light for a luminaire may be any type of artificial light emitting device, several examples of which are included in the discussions below. In a typical installation for the adaptive illumination system, at least the pixel controllable array and the optic would be elements of a light fixture or other type of luminaire for mounting in proximity to the illuminated face of the architectural panel with an appropriate output angle for the illumination light from the array and optic.

Terms such as "artificial lighting," as used herein, are intended to encompass essentially any type of lighting that a device produces light by processing of electrical power to generate the light. An artificial lighting device, for example, may take the form of a lamp, light fixture, or other luminaire that incorporates a light source, where the light source by itself contains no intelligence or communication capability, such as one or more LEDs or the like, or a lamp (e.g. "regular light bulbs") of any suitable type. The general illumination light output of an artificial illumination type luminaire, for example, may have an intensity and/or other characteristic(s) that satisfy an industry acceptable performance standard for a general lighting application.

The term "coupled" as used herein refers to any logical, optical, physical or electrical connection, link or the like by which signals or light produced or supplied by one system element are imparted to another coupled element. Unless described otherwise, coupled elements or devices are not necessarily directly connected to one another and may be separated by intermediate components, elements or communication media that may modify, manipulate or carry the light or signals.

Light output from the light fixture or other type of luminaire may carry information, such as a code (e.g. to identify the luminaire or its location) or downstream transmission of communication signaling and/or user data. The light based information transmission may involve modulation or otherwise adjusting parameters (e.g. intensity, color characteristic or distribution) of the illumination light output from the device.

Reference now is made in detail to the examples illustrated in the accompanying drawings and discussed below. FIG. 1 illustrates a controllable array 11 of solid state light emitters. Although other types of controllable emitters array may be used, several specific examples discussed below utilize a high-resolution, pixel controllable array of solid state light emitters. The example array 11 includes a semiconductor chip carrying a matrix of solid state light emitters at pixels 13 of the array. Although not shown, the same or another chip incorporated in the device 11 may carry the circuitry of a corresponding driver coupled to selectively supply power to the solid state light emitters at the pixels 13. The chip is enclosed in a housing 15 with a suitable window over the emitter outputs.

The high-resolution example utilizes light emitting diodes (LEDs) as the emitters of the array, although other solid state emitter devices may be used. Although each pixel 13 of the array 11 could include multiple LEDs, for example of different color characteristics (e.g. for color tuning), in one example, each of the pixels 13 of the array 11 includes a single LED for emitting white light (e.g. based on ultraviolet or blue pumped phosphor conversion). The LED at each pixel is controllable with respect to full ON and OFF states; and in the example, is controllable to some degree with respect to intermediate levels of output intensity.

Although other array devices may be used, an example lighting system may utilize a high-resolution, pixel controllable array of white emitters such as that originally developed for adaptive vehicle headlights by Osram Opto Semiconductors and described in Osram's literature as "Eviyos." In such an example, the array may take the form of a chip of approximately 4 mm×4 mm that carries LEDs at 1024 pixels. A high-resolution emitter array therefore may have solid state emitters for 1024 or more pixels. The examples utilize a single chip array in a single package or housing, although additional chips in the same or additional packages/housings may be utilized increase the number of solid state emitters so as to provide increased light output and/or an increased range of variable light output distribution. Alternatively, arrays with more or fewer pixels may be used.

Although smaller and potentially having lower resolution than a typical display, the controllable array 11 operates much like a direct output LED display in that the output of light at each pixel is controllable. For lighting purposes, control of which LEDs (at the corresponding pixels) are operating at a given time allows control of which regions are illuminated by the output light from the array 11. Control of the driver current supplied to each of the LEDs, to control output intensity of selected LEDs, allows control of the intensity of light directed through the optic to various regions of the illuminated area on the face of the architectural panel.

Figure 2:
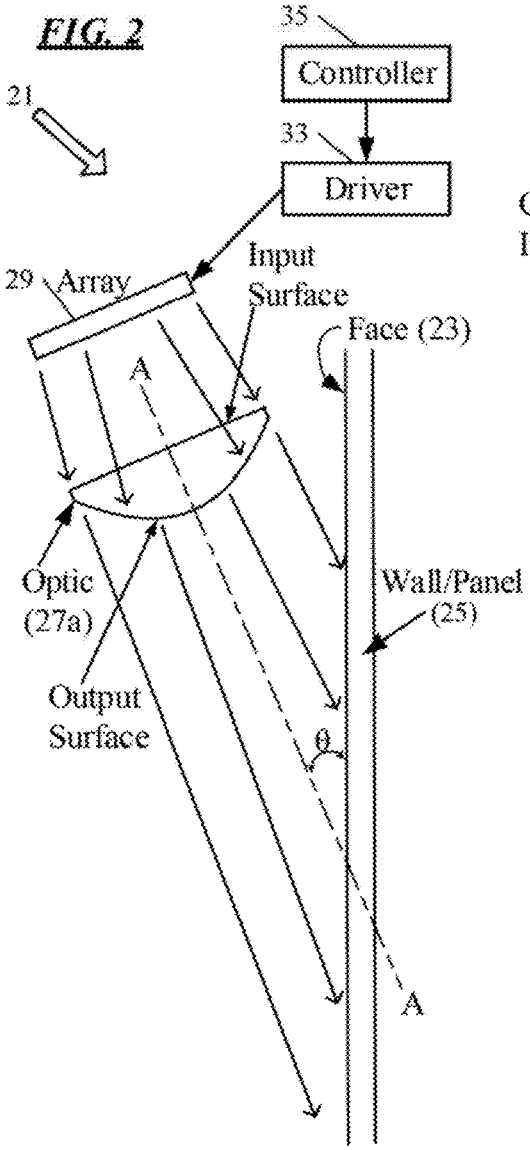
FIGS. 2 and 3 are partially side cross-sectional views and partially block diagrams of systems for general illumination of a face of an architectural panel, using different examples of the optic.
Figure 3:
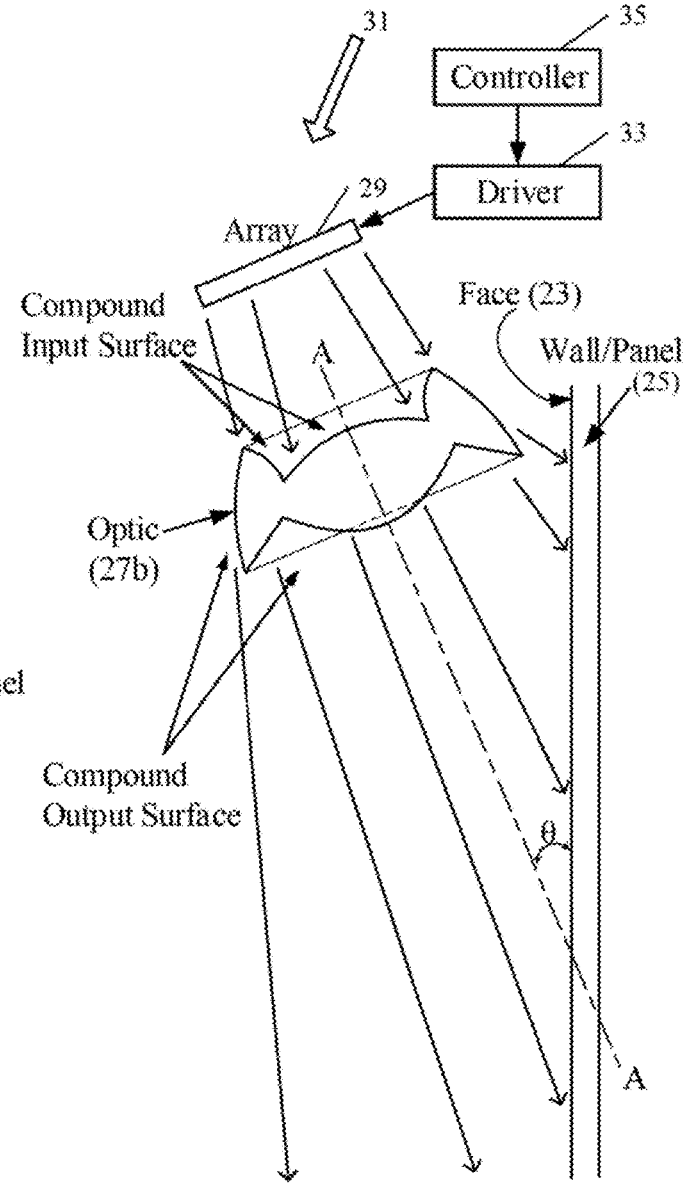

FIGS. 2 and 3 show two similar examples of lighting systems 21, 31 for illuminating a surface on the face 23 of an architectural surface panel, e.g. of a wall 25 or the like. In each example, the system 21, 31 includes an optic 27*a* or 27*b*. In each example, the system 21, 31 also includes a pixel controllable array of solid state light emitters 29. Although shown separated by some distance, for illustration purposes, the output of the pixel controllable array 29 may be fairly close in proximity to the input surface of either optic 27*a* or 27*b*. Aspects of the different optics are discussed more, later. The distance between the array and optic may set so as to optimize optical performance of the system, for example, based on the design and optical characteristics (e.g. focal length(s)) of the particular type of optic used in a particular system and/or the distance from and orientation relative to the architectural panel for a particular installation.

As noted in the discussion of FIG. 1, the array may be a high-resolution array having at least 1024 pixels, and each pixel of the array may include a LED of a type for emission of white light. The optic 27*a* or 27*b* is configured to be aimed so that its optical output axis A-A is oriented at an acute angle θ relative to a plane of the face 23 of the architectural wall/panel 23. In the illustrations of FIGS. 2 and 3, the face 23 is shown as a flat surface, which for convenience also depicts the plane of the face 23. The pixel controllable array 29 of solid state light emitters is coupled to selectively emit light from emitters at pixels of the array 29 through the optic 27*a* or 27*b* toward different regions of the face 23 of the architectural panel 23.

Each of these example systems 21, 31 also includes a driver 33 coupled to selectively drive individual light emitters at pixels of the array 29. The driver 33, for example, may be a controllable multi-channel power supply circuitry having at least one channel to supply power to each of the emitters of the array 29. A controller 35 is coupled to control the individual light emitters at pixels of the array 29, via the driver 33. The controller 35 is configured to control the emitters of the array 29 so as to adaptively illuminate surface topology features (not visible in the illustrations in FIGS. 2 and 3) of the face 23 of the architectural panel 25, by selectively controlling operations of various ones of the light emitters to selectively direct and/or selectively control intensity of light through the optic 27*a* or 27*b* to selected regions of the face 23 of the architectural panel 25.

A light fixture including the optic 27*a* or 27*b* and the array 29 is located to emit light about its output axis A-A at a relatively small angle θ, between the axis and the illuminated face 23 of the architectural panel 25. In the examples of FIGS. 2 and 3, the surface 23 is that of a vertical wall 25, the plane of the face 23 is at least substantially vertical, and the light is directed downward at a steep angle but not quite vertical. The angle for wall grazing may be steeper (smaller θ in the illustrated orientation) than an angle for wall washing. As an alternative for wall illumination, the light may be directed upward at an appropriate angle θ relative to the plane of the face 23 or horizontally (in and out of the plane of the illustrations) at an appropriate angle θ relative the plane of the face 23 or in some other way across the wall type architectural panel 25. The light fixture, however, may be at other orientations to similarly illuminate faces/surfaces of other panels at other non-vertical orientations, such as a ceiling, a counter top or desk top, etc.

A variety of different designs may be used to implement the optic. FIGS. 2 and 3 show two different variations of the optic 27*a*, 27*b*. Selective actuation of the LEDs of different pixels of the array 29 to selectively emit light through the optic 27*a* or 27*b* provides selective output of illumination light toward different regions of the face 23 of the architectural panel 25. Stated another way, selective ON/OFF control of the emitters provides selective light throw from the optic 27*a* or 27*b* to different regions; and selective intensity control may enable control of how much or how little of the emitted light is directed to the different regions.

The pixel controllable array 29 of solid state light emitters is coupled to output light from the emitters through an optic. An unprocessed distribution of light from the array 29 would tend to illuminate of the face 23 of the panel 25 with lower intensity illumination on regions of the face 23 of the panel 25 further away from the light fixture or the like containing the array 29 (by operation of an inverse square law). For grazing or washing a wall from a ceiling mounted fixture, for example, the fixture provides more light (higher intensity) to regions on the face 23 of the wall panel 25 nearer the fixture than to regions of the face 23 of the wall panel 25 nearer the floor. The design of the optic can provide some compensation, for example, based on an optic design that tends to reduce light output toward regions near the ceiling and the array and optic as well as increase light output toward more distant regions of the face 23 of the wall panel 25 near the floor. In the system 21, 31 with a pixel controllable array of emitters, a lamp correction profile for controlling the emitter outputs may also provide some degree of adjustment of intensity output of emitters of various pixels of the array 29 to compensate for the distance to the various regions of the face 23 of the panel 25 (e.g. in addition to compensation for shadow effects caused by the surface topology features on the face of the panel.

The examples described here and shown in the various drawings are providing adaptive general illumination of a face of an architectural panel to change the appearance of surface topological features on the face, for illumination applications like wall washing or wall grazing. The examples need not project an image onto the face 23 of the architectural panel 25. Hence, the lens or lenses used to implement an optic in a system like 21 or 31 need not be an imaging optic. The example optics 27*a*, 27*b*, particularly the implementations like that shown at 27*b* in FIG. 3, are non-imaging lenses.

The system 21 of FIG. 2 includes a plano convex lens as the optic 27*a*. Such a lens is made of suitably shaped solid transparent material. In such an implementation, the lens of optic 27*a* has a flat input surface facing the pixel controllable array 29 of light emitters, and the lens of optic 27*a* has a convex opposite surface that serves as the output surface of the optic 27*a*. The plano convex lens is a relatively simple example of an optic for efficiently directing the light output while somewhat expanding the angular range of light output from the array 29. Solid optic lenses of other relatively common, simple shapes may be used, such as a convex lens with a negative meniscus, a convex lens with a positive meniscus or a bioconvex lens. The lens converts the relatively Lambertian output distribution of a pixelated source formed by the pixel controllable emitter array 29 into a defined mapping of light on the face 29. Variation of light characteristics at pixels of the array 29 produces similar variations in light refracted through the lens type optic 27*a* onto regions of the illuminated area of the face 29. The illustrated example includes a single lens in the optic 27*a*, however, the system 21 may utilize multiple or compound arrangements of lenses to form the optic 27*a*.

The optic 27*b* may provide an efficient delivery of the light where desired in the various emission states of the emitter array 29. As noted, examples are not projecting an image onto the face 23, but the examples instead are providing adaptive general illumination of a face 23 of an architectural panel 25 to change the appearance of surface topological features on the face. The example optic 27*b* with the compound input and output surfaces is a not actually an imaging optic, although it may not actually be a non-imaging optic (in the strict optical-science sense of the 'non-imaging' term). By contrast, a projector would utilize an imaging optic.

In the example system 31, the optic 27*b* is a circular compound-surface lens (shown in cross-section without hatching), e.g. if viewed from a perspective along the optical axis A-A. The circular compound-surface lens is made of suitably shaped solid transparent material having aspheric or spheric surfaces. The circular lens is suitable, for example, to an array 29 that has a substantially square pixel matrix, such as that shown in FIG. 1, or a square arrangement of some number of such arrays. A rectilinear lens with a similar cross section may be utilized with an array that has a substantially rectangular (non-square) pixel matrix or with one or more elongated rows of arrays 29 each of which has substantially square pixel matrix like that shown in FIG. 1. Such a rectilinear compound-surface lens may have surfaces that correspond to sections of one or more cylinders or the like (where the circular example has aspheric or spheric surfaces). For convenience, further discussion of the compound-surface lens implementation 27*b* will concentrate on the circular example of the compound-surface lens implementation of the optic.

The compound-surface lens implementation 27*b* is positioned over or across the path of light outputs from the emitters of the pixel controllable array 29. The aspheric or spheric surfaces of the compound-surface lens 27*b* include, for example, a compound input surface facing in a direction to receive light from the array 29 and a compound output surface. In a circular implementation of the compound-surface lens 27*b*, the compound input and output surfaces are centered along the optical axis A-A.

The input surface of the compound-surface lens 27*b*, facing the emitters of the array 29, includes an input peripheral portion and an input central portion, both of which are somewhat convex in the illustrated example. The input peripheral portion extends from relative proximity to the array 29 toward an interface or edge formed at a junction with the input central portion; and the input peripheral portion has an angled convex curvature. The input central portion curves towards the array 29, e.g. with a convex curvature across the optical axis A-A and facing directly toward the array 29 in the illustrated example orientation. The convex central portion of the compound input surface is spheric in the example, e.g. corresponds in shape to a portion of a sphere.

The compound output surface (opposite the input surface and the array 29) includes an output lateral portion, an output shoulder portion, and an output body portion. The output lateral portion forms the outer peripheral surface of the lens of optic 27*b*. The output lateral portion is considered part of the compound output surface in that some light may emerge via at least part of that peripheral surface, although that surface may provide total internal reflection (TIR) for other light, depending on the angle of diffracted light rays from different emitters at different pixels of the array 29. The output lateral portion extends away from relative proximity to the array 29, where it forms an interface or edge at the junction with the peripheral portion of the compound input surface. The output lateral portion curves away from the interface or edge formed at the junction with the input peripheral portion of the lens input surface, and intersects the output shoulder portion at a distal edge or interface away from the array 29. The output shoulder portion of the output surface extends inward from the output lateral portion of the compound output surface to where the shoulder portion abuts the output body portion of the compound output surface. The output body portion curves outwards (convex) away from the array 29, e.g. with a convex curvature across the optical axis A-A and away from the edge formed at the abutment with the output shoulder portion. The convex output body of the compound output surface is spheric in the example, e.g. corresponds in shape to a portion of a sphere.

Incoming light rays surface illumination, emitted by at least one of the illumination light emitters of the array 29, can first pass through the compound input surface where the incoming light rays undergo refraction to shape or steer the illumination lighting. After passing through the compound input surface, the refracted incoming light rays can then pass through the portions of the compound output surface where the refracted incoming light rays undergo further refraction to shape or steer the illumination lighting.

Alternatively or additionally, after passing through the compound input surface, the refracted incoming light rays can then strike the output lateral portion of the compound output surface (i.e. the peripheral wall/surface of the lens 27*b*) where the incoming light rays undergo total internal reflection (TIR) to further shape or steer the illumination lighting. After striking the output lateral portion, the refracted and TIR incoming light rays can pass through the output shoulder portion with further refraction.

With a compound-surface lens such as optic 27*b*, activation of different emitters at different pixels of the array 29 results in different refraction and thus different directions of light output. Additional information about lenses like the example of FIG. 3 may be found in Applicant's: U.S. patent application Ser. No. 15/868,624, filed Jan. 11, 2018; U.S. patent application Ser. No. 15/914,619, filed Mar. 7, 2018; and U.S. patent application Ser. No. 15/924,868, filed Mar. 19, 2018, the complete disclosures of all three of which are incorporated entirely herein by reference. The shape of optic 27*b* and the description above are given by way of non-limiting examples, and other compound-surface lenses may be utilized.

The compound-surface lens type optic 27*b* may provide a more precise variable light output throw as a function of position of each activated pixel emitter of the array 29 relative to the various surface portions of the lens 27*b*. The compound-surface lens type optic 27*b* also may be more efficient in delivering the light to the appropriate regions of the face 23. The optic 27*a*, however, is a simpler, more common type of optic that may be cheaper to manufacture and deploy.

The example optics 27*a* and 27*b* are lenses. It should be appreciated that adaptive illumination systems of the type discussed herein may use other types of optical elements, such as reflective optics (e.g. one or more appropriately contoured mirrors). Mirrors or lenses or other optics may be specifically designed for the particular type of pixel controllable emitter array 29 and/or for the particular shape of face 23 (e.g. having a flat contour or having a particular non-flat contour).

Figure 4:
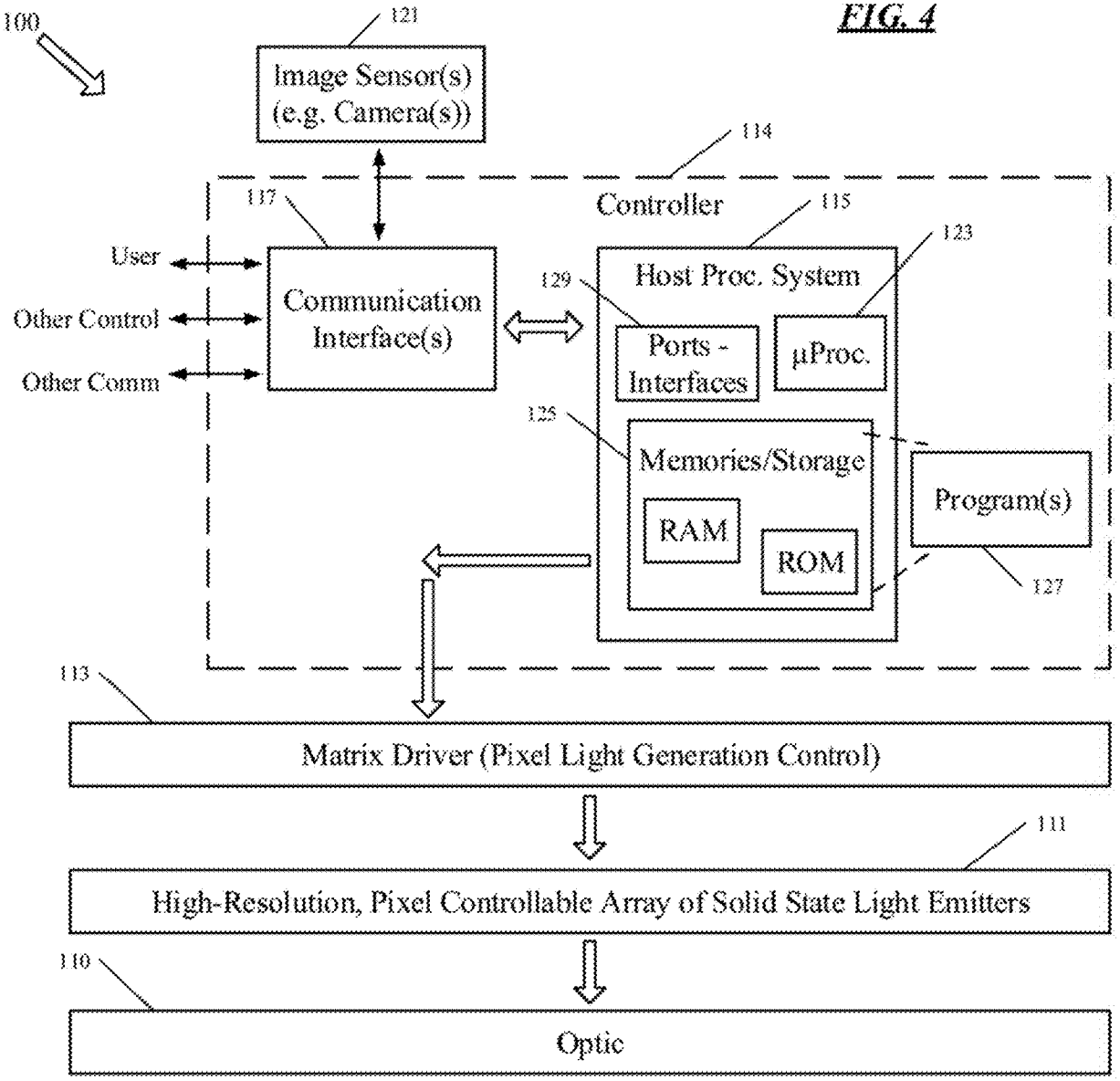
FIG. 4 is a high level functional block diagram of a lighting system for illuminating a face of an architectural panel, including a processor based example of the controller.

FIG. 4 depicts, in block diagram form, an example of a lighting system 100 for illuminating an area of a face of an architectural panel, as shown in FIG. 2 or FIG. 3. Although other control architectures may be utilized, the example system 100 utilizes a processor based 'intelligent' arrangement with associated communication capabilities.

At a high level, the general lighting system 100 is includes an optic 110 and a high-resolution, pixel controllable array 111 of solid state light emitters. The optic 11 is generally similar to one of the optics discussed above relative to FIGS. 2 and 3. As outlined earlier, the optic 110 is configured to be aimed to have an optical axis at an acute angle relative to the face of the architectural panel. The array 111 in this example is a high-resolution implementation of the pixel controllable array of solid state light emitters discussed earlier relative to FIGS. 1 to 3. The high-resolution, pixel controllable array 111 of solid state light emitters is coupled to selectively emit light from emitters at pixels of the array through the optic 110 toward different regions of the face of the architectural panel.

The example system 100 also includes a driver 113 coupled to selectively drive individual light emitters at pixels of the array. A controller 114 is coupled to control the individual light emitters at pixels of the array 111, via the driver 113. The controller 114 is configured to control the emitters of the array 111 so as to adaptively illuminate surface topological features of the face by selectively activating ones of the light emitters to selectively direct light through the optic to selected ones of the regions of the face of the architectural panel.

The driver 113 includes circuitry coupled to control light outputs generated by the light emitters at the pixels of the array 111. Although the driver 113 may be implemented as an element of the controller 114, in the example, the driver 113 is located separately from the controller 114. The driver 113 may be a separate device on one or more integrated circuits, or driver 113 may be integrated on the same semiconductor chip as the emitters forming he array 111.

In the example using the high-resolution pixel controllable array 111 of white LED type emitters, the LED at each pixel in controllable with respect to ON/OFF states and supports variable in-between light output intensity settings. Other types of array may include two or more emitters of different color characteristics (e.g. white plus a specific color, RGB or other tri-color emitter sets, RGBW, etc.) at the individual pixels of the array to allow controlled adjustment of color characteristic of the pixel outputs.

The driver circuit 113 may be a matrix type driver circuit, such as an active matrix driver or a passive matrix driver. Although active-matrix driver circuitry may be used in the driver 113, to drive the individual emitters at the pixels of the array 111, passive matrix driver circuitry may be sufficient for many general illumination applications. For example, a passive matrix driver circuit may be a more cost effective solution to drive the emitters of the array 111 for general illumination applications such as described herein, particularly for any pixel emitter array configuration or application that need not be dynamically controlled at a fast refresh rate. An issue with passive matrix is that the brightness scales with the number of rows in the array of controllable pixel emitters. Both active matrix and passive matrix can independently control pixel outputs. For a driver circuit for an array that is not necessarily high-resolution, active matrix or passive matrix driving methods may not be required. In any event, the lighting system 100 provides general illumination light output from the array 111 through the optic 110 in response to lighting control signals received from the matrix driver 113.

Equipment implementing functions like those of lighting system 100 may take various forms. The pixel controllable light generation array 111 and the optic 110 typically will be elements of a light fixture or other type of luminaire configured for angled surface illumination, such as wall grazing or wall washing. In some examples, the controller 114, matrix driver 113, high-resolution array 111 and optic 110 may be elements of a single hardware platform, e.g. a single luminaire. In other examples, some components attributed to the lighting system 100 may be separated from the pixel controllable light generation array 111 and the optic 110. Stated another way, a light fixture or other suitable type of luminaire may have all of the above hardware components of the system 100 on a single hardware device or in different somewhat separate units. In a particular hardware-separated example, one set of the hardware components may be separated from the pixel controllable light generation array 111, such that the controller 114 and the matrix driver 113 may control an array 111 from a remote location. In an alternative example, with each luminaire including a matrix driver together with the array 111, one controller 114 may control such luminaires to graze or wash the face(s) of one or more architectural panels.

As shown by way of example in FIG. 4, the controller 114 of the lighting system 100 includes a host processing system 115 and one or more communication interface(s) 117. The host processing system 115 provides the high level logic or "brain" of the system 100. In the example, the host processing system 115 includes data storage/memories 125, such as a random access memory and/or a read-only memory, as well as programs 127 stored in one or more of the data storage/memories 125. The host processing system 115 also includes a central processing unit (CPU), shown by way of example as a microprocessor (μP) 123, although other processor hardware may serve as the CPU. An alternate implementation, for example, might utilize a micro-control unit (MCU) which incorporates the CPU processor circuitry, the memories, interfaces for input/output ports, etc. on a single system on a chip (SoC).

The host processing system 115 is coupled to the communication interface(s) 117. In the example, the communication interface(s) 117 offer a user interface function or communication with hardware elements providing a user interface for the general illumination system 100. The communication interface(s) 117 may communicate with other lighting systems at a particular premises. The communication interface(s) 117 may communicate with other control elements, for example, a host computer of a building and control automation system (BCAS). The communication interface(s) 117 also may support device communication with a variety of other systems of other parties, e.g. the device manufacturer for maintenance or an on-line server, such as server for downloading of software and/or configuration data.

The system 100 may also include one or more image sensor(s) 121. Such an image sensor 121 may be any type of digital camera (e.g. a surveillance camera, a mobile or wearable device with a camera, etc.) of suitable resolution for providing image data for use in the adaptive surface illumination operations described herein. If provided, an image sensor 121 may be coupled via a communication interface to provide data of one or more captured images of the illuminated area of the architectural surface for processing by the host processing system 114. The image sensor 121 may be coupled/operated to provide such image data during an initial set up for illumination of a particular surface area, for example, if the reset of the system will be statically configured to provide particular illumination of the surface area for some long period of time. Alternatively, the image sensor may be continuously available and utilized from time to time for dynamic changes in the array operations, to adapt illumination output to conditions that may change the shadow effects of various regions within the illuminated surface area of the face of the architectural panel.

The illustration, by way of example, shows a single processor in the form of the microprocessor 123. It should be understood that the controller 114 may include one or more additional processors, such as multiple processor cores, parallel processors, or specialized processors (e.g. a math co-processor). Particularly for dynamic image responsive control, it may be advantageous to include an image processor in addition to the microprocessor 123.

Although specially configured circuitry may be used in place of microprocessor 123 and/or the entire host processor system 115, the drawing depicts a processor-based example of the controller 114 in which functions relating to the controlled operation of the system 100, including operation of the high-resolution, pixel controllable array 111 of solid state emitters, may be implemented by the programming 127 and/or configuration data stored in a memory device 125 for execution by the microprocessor 123 (or other type of processor). The programming 127 and/or data configure the processor 123 to control system operations so as to implement functions of the system 100 described herein.

Aspects of the system 100 for adaptive surface illumination therefore include "products" or "articles of manufacture" typically in the form of firmware or other software that include executable code of programming 127 and/or associated configuration data (not separately shown) that is/are carried on or embodied in a type of machine readable medium. "Storage" type media include any or all of storage devices that may be used to implement the memory 125, any tangible memory of computers or the like that may communicate with the system 100 or associated modules of such other equipment. Examples of storage media include but are not limited to various semiconductor memories, tape drives, disk drives and the like, which may provide non-transitory storage at any time for the programming 127 and/or the configuration data. All or portions of the programming and/or data may at times be communicated through the Internet or various other telecommunication networks. Such communications, for example, may enable loading of the programming and/or data from a computer or the like into the host processing system 115 of the controller 114, for example, from a management server or host computer of the lighting system service provider into a lighting system 100. Thus, another type of media that may bear the programming 127 and/or the data includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. As used herein, unless restricted to non-transitory, tangible or "storage" media, terms such as computer or machine "readable medium" refer to any medium that participates in providing instructions to a processor for execution.

Figure 5:
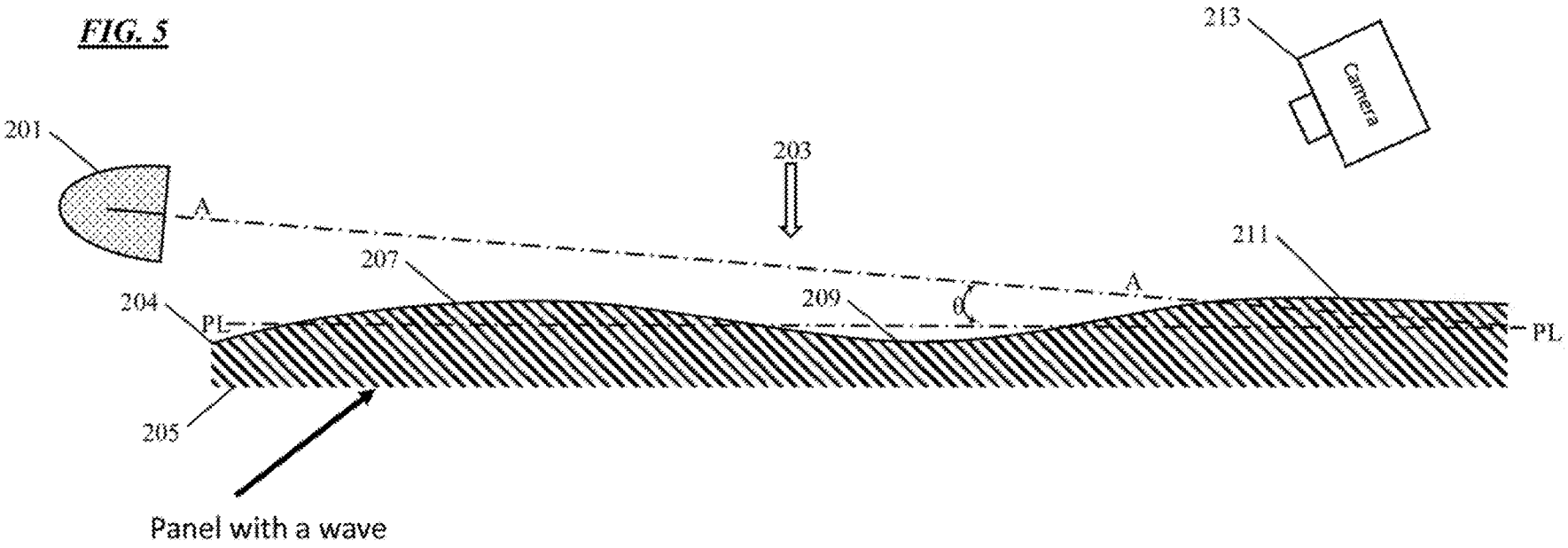
FIGS. 5 to 10 illustrate several different states of selective angled illumination of a face of an architectural panel, using a light fixture containing the pixel controllable array and optic of one of the example systems of FIGS. 2 and 3.

FIGS. 5 to 10 illustrate several different states of selective angled illumination of an architectural surface, which has features that may otherwise cause shadow effects, using the pixel controllable array and optic of one of the example systems of FIGS. 2 and 3. In FIGS. 5 to 10, the half oval shape to the left is a convenient symbol (only, and not limiting) for a light fixture 201 that includes the combination of a pixel controllable array of solid state emitters and a suitable optic, as described relative to FIGS. 2 to 4. FIG. 5 shows the fixture 201 and the panel 205 in side or cross-section, but with the fixture turned OFF.

The light fixture 201 provides angled illumination of a face 203 of an architectural panel 205, for example, around the optical output axis A-A (see FIG. 5). The light fixture 201 is aimed so that its optical output axis A-A is oriented at an acute angle θ relative to a plane PL-PL of the face 203 of the architectural wall/panel 205. The surface(s) 204 of the face 203 in this example forms a number (one or more) of surface topological features, such as the wave shown in FIGS. 5 to 10. The architectural panel 205 may be a wall or ceiling or the like; although for convenience the fixture 201 is shown in an angled orientation for illumination of an architectural panel 205 on a horizontal panel, such as a floor, countertop, table or desktop, or the like. As noted earlier regarding the system examples, the fixture 201 may be used for angled illumination in other directions across the surface 204 and/or to illuminate panels/faces that are oriented at angles other than horizontal or vertical. In the illustrated horizontal arrangement of the panel 205, the plane PL-PL of the face 203 is shown as a horizontal plane approximately at the middle or average depth/height of the feature waveform. The plane, however, is an approximation of the overall face 203 of the architectural panel 205; and alternate approximations may be identified in other ways, e.g. as a plane formed by several of the peaks of the features, a plane formed by several of the valleys of the features, or the like.

For convenience, only small portions of the panel 205 and the face 203 are shown enlarged in these drawings. The surface 204 in the example is not uniformly flat and instead includes surface topological features that are raised or lowered from the average height of the face 203 of the panel 205, in the illustrated example orientation. Such features may be imperfections or may be deliberately provided as a texture or the like for the surface 204. Features may have a variety of shapes and sizes. For ease of illustration, these drawings show an example of the face 203 of the architectural panel 205 having a fairly regular recurring wave pattern as surface 204. In the cross-sectional views, the features provided by the wave include a peak 207, and valley 209 and another peak 211.

FIGS. 5 to 10 also show a camera 213, by way of an example of an image sensor, e.g. like 121 in FIG. 4. The camera 213 is aimed to capture an image of at least the area of the face 203 illuminated by the light fixture 201. As discussed in more detail later, data derived from the captured image can be processed to develop or modify a lamp correction profile, which is a data file defining settings for the emitters of pixel controllable array 111, to achieve and/or maintain an intended illumination effect across the area of the face 203 illuminated by the light fixture 201. For example, for a uniform illumination application, processing to define the lamp correction profile may be configured to review the image data and select intensity settings for the emitters of the pixel controllable array 111 to eliminate striations or the like. Alternatively, a procedure to reduce differences in intensity of adjacent regions of the face may reduce gradients (rate of change) in intensity, which still reduces striations by smoothing out the appearance to an observer. In an iterative process for dynamically maintaining a generally uniform appearance for a human observer (e.g. little or no humanly perceptible striations due to gradients or other differences in intensity), the processing may be configured to repetitively review image data and select intensity settings for the emitters of the pixel controllable array to eliminate striations or the like from further image data.

For convenience, FIGS. 5 to 10 show only a single light fixture 201 and a single camera 213. In an actual deployment, there may be two or more light fixtures 201 along the wall or other panel 205 at locations sufficiently close to produce some overlap of illumination output on the face 203 of the panel 205. Each array 111 may have its own matrix driver 113 for the emitters at the pixels of the array. A row of three fixtures for downward washing or grazing of the face of a wall, for example, would include three arrays 111 (one in each fixture) and three associated matrix drivers 113 (one in each fixture or one connected to the array in each fixture). One system controller 114, coordination between several controllers 114, or a higher level host processor (not shown) controlling the three controllers 114 may be utilized to coordinate the operations of the three light fixtures 201 illuminating the face 203 of such a wall type panel 205.

Using one or more processors of multiple lighting systems 100 (FIG. 4) or using a higher level computer (user terminal or server) in communication with multiple lighting systems 100, the processing would develop lamp correction profiles for all of the light fixtures 201, which together control the emitters of the pixel controllable arrays 111 of the fixtures to provide the desired appearance of uniformity or texture enhancement over the entire illuminated area of the face 203 of the panel 205 illuminated by the group of light fixtures 201. If the wall is large enough, it may be useful to have multiple cameras 213 at locations that allow stitching of the image data together to logically obtain an image of the entire illuminated area of the wall.

In many applications, the camera(s) 213 may be on-site only during system set-up. Once the lamp correction profile is created and stored, the camera(s) 213 may no longer be necessary. In such an arrangement, a technician with one or more cameras might come back and run the set-up again, e.g. to obtain a new lamp correction profile for one or more light fixtures 201 in view of some change on or in the vicinity of the face of the wall or other panel.

In other installations/applications, it may be desirable to dynamically change operations of the emitters of one or more arrays (in one or more fixtures 201), for example, to compensate for dynamic changes effecting lighting of the face 203 of the panel 205. For example, it may be desirable to compensate for changes in natural light from a window or skylight that also may illuminate the face 203 of the panel 205. By way of another example, it may be desirable to compensate for shadows cast on the face of a wall or the like by movable objects, e.g. people, when in the vicinity of the panel 205. For the more dynamic, substantially real time control, the camera(s) 213 would be permanently installed in the vicinity of the panel 205 and aimed at the illuminated surface area or the panel face 203. After calibration, image data from the camera(s) 213 would provide feedback that the system 100 could use to adjust the output intensities of light from the emitters of the array(s) of the fixture(s) 201 illuminating the face 203 of the architectural panel 205 illuminated by fixture(s) at a particular installation.

A technician setting up a general lighting system for illuminating the architectural surface 203 might observe the bright and dark areas and provide manual inputs via a suitable user terminal device (e.g. mobile device or computer terminal), to adjust operations of the emitters of the pixel controllable array. Alternatively, locations and intensities of illuminations of the brighter and darker regions in the illuminated area of the architectural surface 203 may be detected by processing image data from a camera 213, serving as the image sensor(s) 121 in the system 100 of FIG. 4.

The camera 213/121 or other sensor could be in the lighting system or even in the light fixture 201 or other luminaire portion of the lighting system 100. Most often, the camera would be remote from the light fixture 201 or other type of luminaire in order to provide a better imaging view of the face 203 of the panel 205. Hence, in the example of FIG. 4, rather than interfacing directly to the host processor system 115, the sensor 121 communicates with the host processor system 115 via an appropriate network link and one of the communication interfaces.

The systems as shown in FIGS. 2 to 5 change the illumination of topological features that are present in the illuminated area on the face of the architectural panel. Most examples reduce differences in apparent illumination intensity in the regions of the illuminated area, for example, as would otherwise result from angled illumination of the face of the panel. The technology, however, may also be operated to further emphasize the presence of desirable features, e.g. to highlight texture or one or more design elements that form one or more surface topological features on the illuminated surface area of the face of the architectural panel. It may be helpful to consider an example, such as providing an improved appearance of uniformity, with more specific reference to FIGS. 6 to 10.

Figure 6:
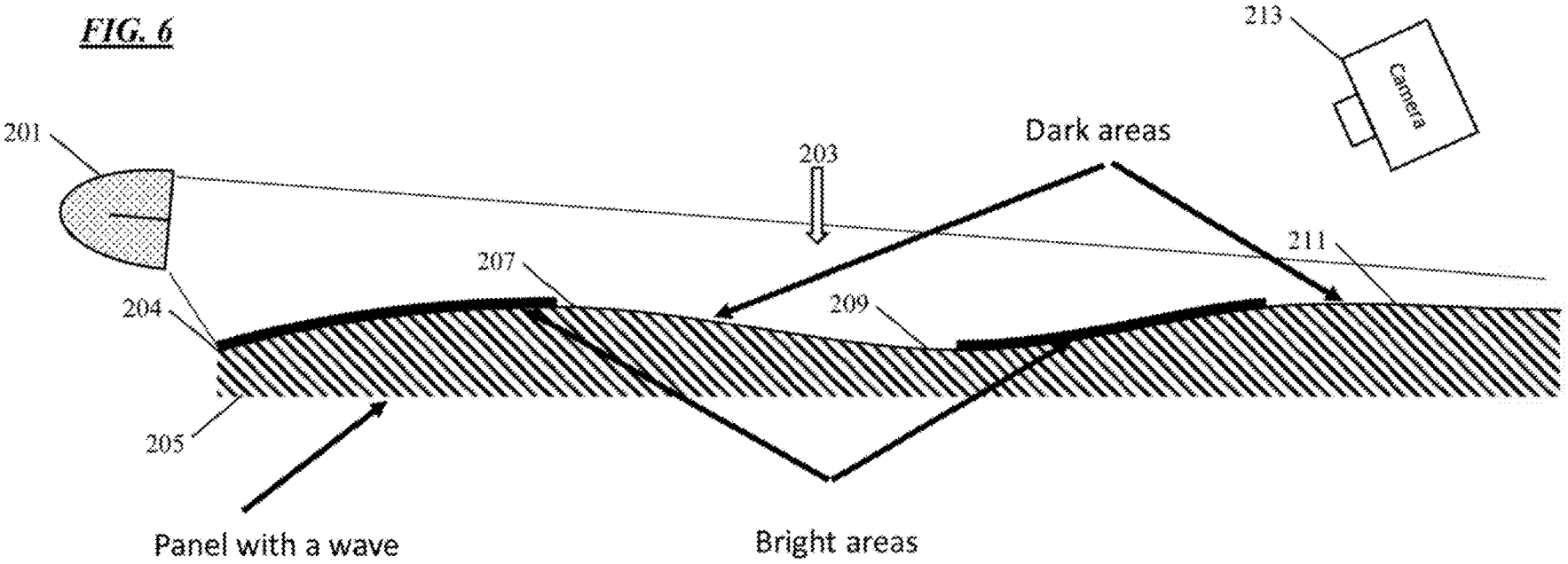

FIG. 6 shows a state in which the light fixture 201 is turned ON but with fairly uniform output intensities from all of the emitters at the pixels of the controllable array, and as distributed through the optic over the angular distribution range of the fixture output across the area of the face 203 that is to be illuminated, for example, before adaptive control of the pixel controllable array of the solid state emitters. For example, all of the emitters of the array may be turned ON at the same relative intensity, e.g. 75% of maximum. The drawing includes thick lines on leading edges going up to the peaks 201, 211 of the waves where the light from the emitters of the fixture 201 tend to create brighter regions on the surface topological features of the illuminated area of the face 203 of the architectural panel 205. In the example, the leading edges of the surface waves more directly face toward the light fixture 201 during illumination. The thick lines are used only as a convenient drawing symbol to indicate the brighter areas and do not represent any structure of the panel 205 or its surface 201. The absence of the thick lines along the surface 204 is used as a convenient way to indicate regions on the surface topological features of the illuminated area of the face 203 of the architectural panel 205 that tend to be darker, for example, due to not facing as directly toward the fixture 201 and/or due to shadows created by an adjacent feature such as a peak 207 or 211. In the example of FIG. 6, the peak 207 tends to create a shadow in the valley 209; therefore the trailing edge of the wave from the peak 207 going down to the valley 209 forms a darker region in the illuminated area of the face 203.

The illustrations in FIGS. 7 to 10 relate to a procedure, for example, to reduce the differences in illumination intensity in the different regions in the illuminated area of the face 203 of the architectural panel 205 and thereby provide an illumination intensity distribution across the face 203 that an observer might perceive as more uniform, for example, for a wall washing application. A similar technique may be used but with alternate changes to the emitter outputs from the array to increase the differences in illumination intensity in the different regions in the illuminated area of the face 203 of the architectural panel 205 and thereby provide greater shadow effects across the face 203 and emphasize the texture or feature details of the surface 204, for example, for a wall grazing application.

Figure 7:
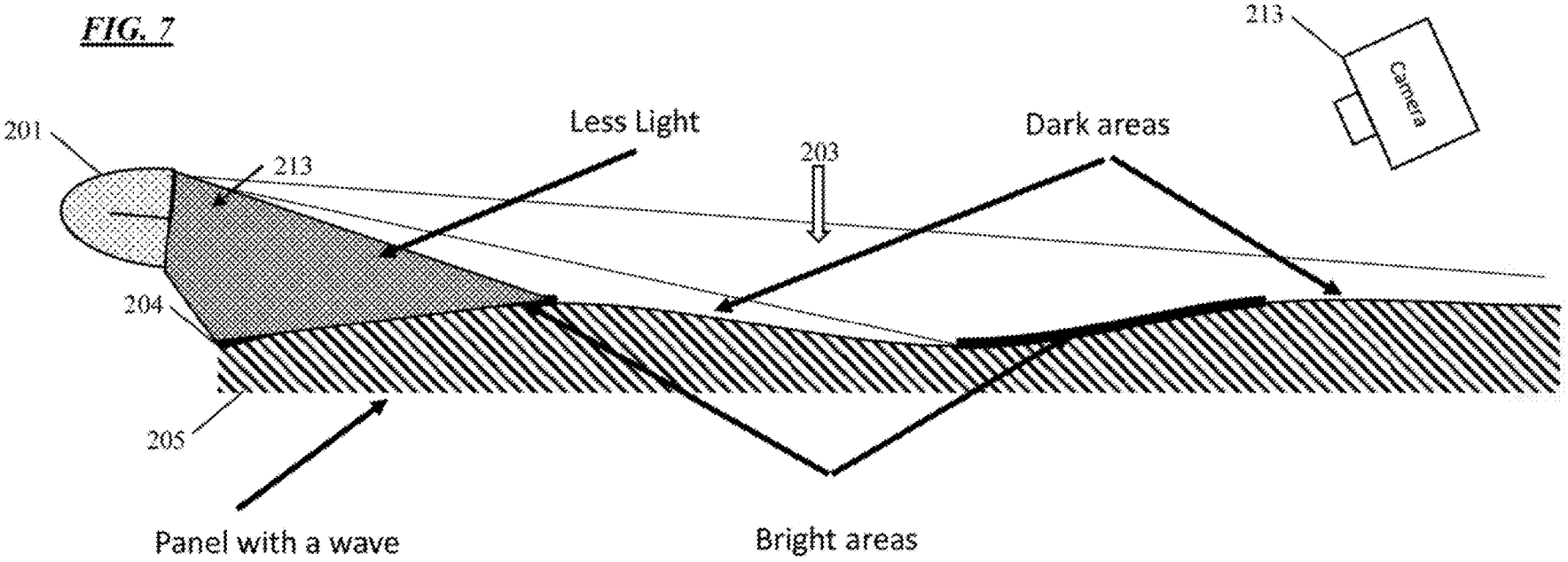
Figure 8:
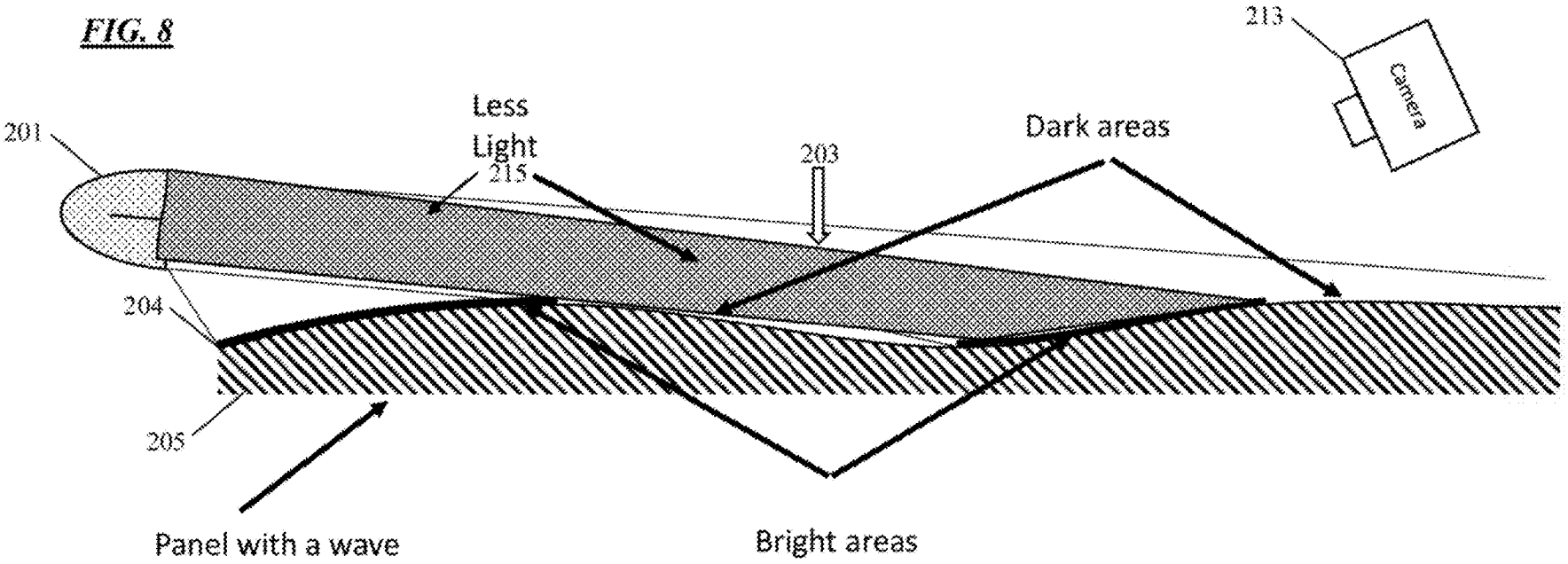

With specific reference to the example of FIGS. 7 to 10, for discussion of a simplified example intended to reduce differences in illumination intensity in the various regions, the drawings show four different shaded segments of the fixture output or "light throws" controlled to have adjusted output intensities. In FIG. 7, a first light throw segment 213 is shaded, but other light throws output by the fixture 201 are not shaded. In FIG. 8, a second light throw segment 215 is shaded, but other light throws output by the fixture 201 are not shaded. Similarly, in FIG. 9, a third light throw segment 217 is shaded, but other light throws output by the fixture 201 are not shaded; and in FIG. 10, a fourth light throw segment 219 is shaded, but other light throws output by the fixture 201 are not shaded. The intensity of light emission in each of the light through segments 213 to 219 is variable between 0% and 100% based on control of the emitters within the pixel controllable array of the light fixture 201. Although shown separately for ease of illustration and discussion, for example, to achieve an intended improvement in uniformity of illumination of the regions in the illuminated area of the face 203 of the architectural panel 205, the lighting intensities of the outputs via all four of the light throw segments 213 to 219 are adjusted as discussed below.

As shown in FIG. 7, the emitters at appropriate pixels of the array of the light fixture 201 are controlled to reduce output intensity and thus reduce the intensity (less light) of illumination directed via the first light throw 213 to the first initially bright area, that is to say on the leading edge of the first wave in the simple example. Similarly, as shown in FIG. 8, the emitters at appropriate pixels of the array of the light fixture 201 are controlled to reduce output intensity and thus reduce the intensity (less light) of illumination directed via the second light throw 215 to the second initially bright area, that is to say on the leading edge of the second wave in the simple example. These adjustments in intensity in the light throws 213, 215 reduce the illumination intensities of the regions that otherwise would be brighter. Due to the different angles of the two light throws 213, 215, the adjustments of intensity would be different for the different light throws 213, 215.

Figure 9:
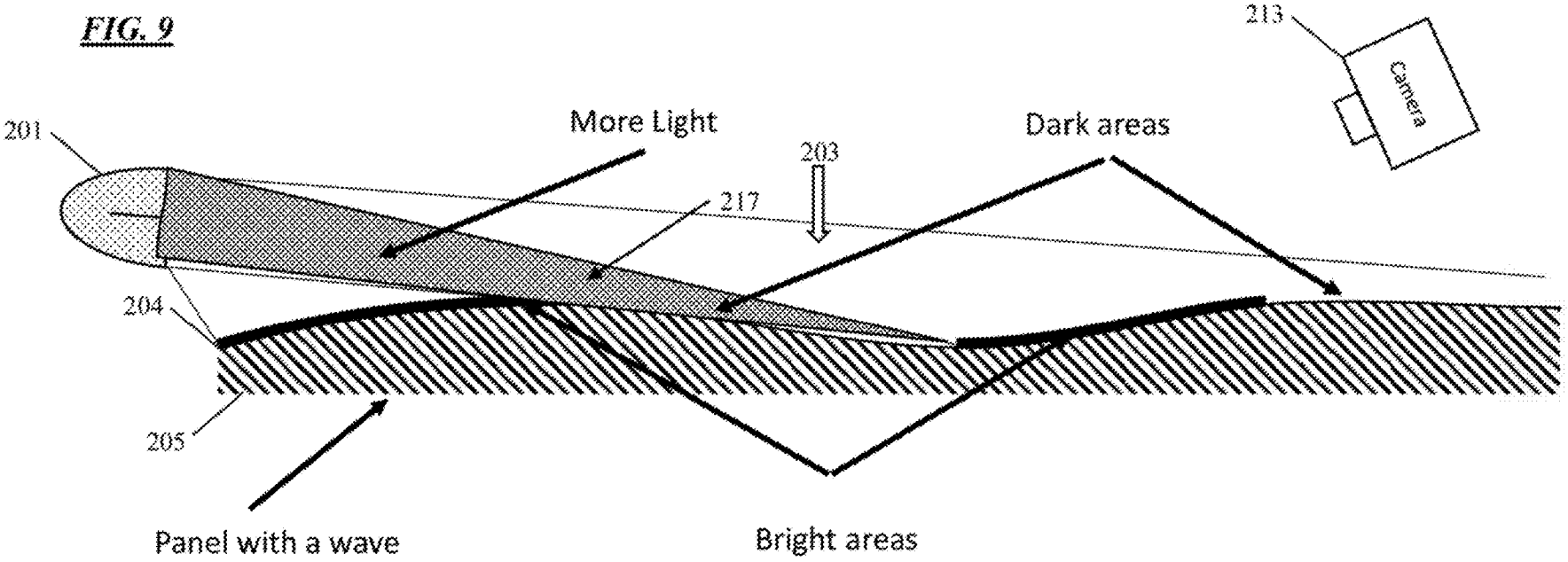
Figure 10:
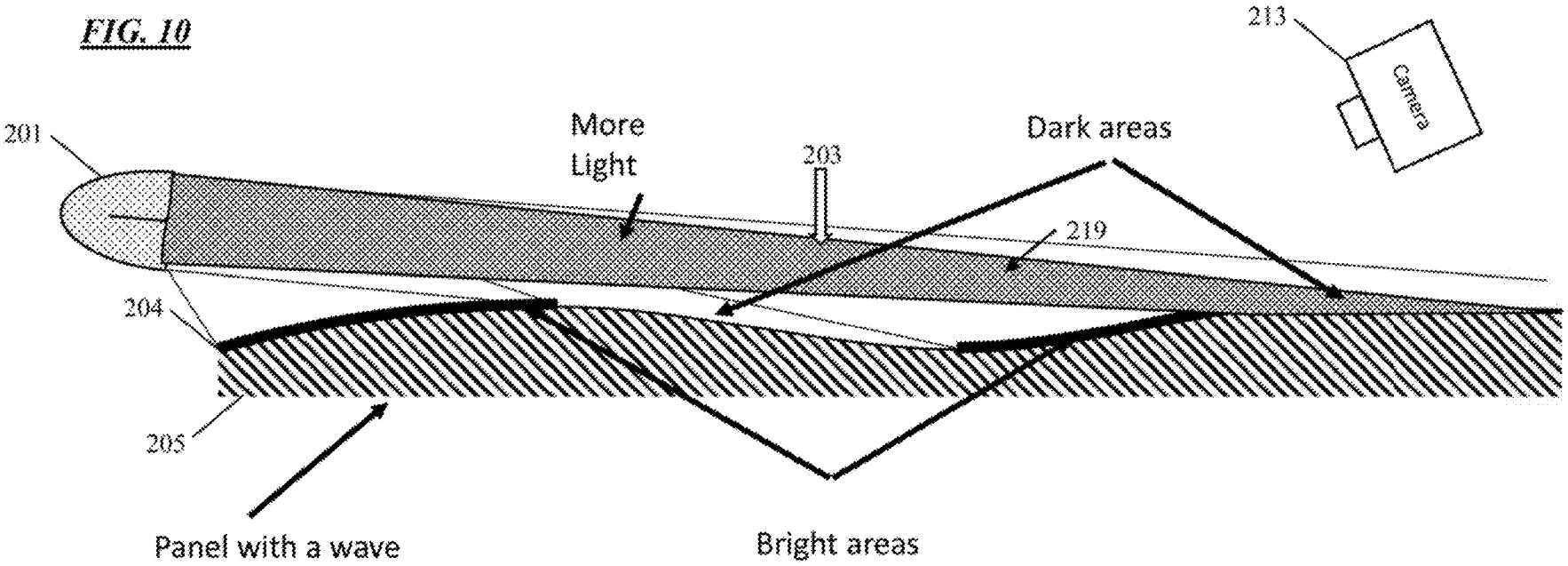

As shown in FIG. 9, the emitters at appropriate pixels of the array of the light fixture 201 are controlled to increase output intensity and thus increase the intensity (more light) of illumination directed via the third light throw 217 to the first initially dark area, that is to say on the trailing edge of the first wave in the simple example. Similarly, as shown in FIG. 10, the emitters at appropriate pixels of the array of the light fixture 201 are controlled to increase output intensity and thus increase the intensity (more light) of illumination directed via the fourth light throw 219 to the second initially dark area, that is to say from the top of the second wave (on the trailing edge, not fully visible in the drawing). These adjustments in intensity in the light throws 217, 219 increase the illumination intensities of the regions that otherwise would be darker. Due to the different angles of the two light throws 217, 219, the adjustments of intensity would be different for the different light throws 217, 219.

The combination of decreases of light directed through light throws 213, 215 and increases of light directed through light throws 217, 219 are selected to provide a more uniform (closer to a desired average value) of illumination in the different regions of the illuminated area of the surface 203. In this simple example, the emitters at the appropriate pixels of the array of the light fixture 201 are controlled to reduce intensity in some regions and increase intensity in other regions of the face 203, so as to implement an intended uniform illumination effect on the face 203, for example, to reduce perceptible striations as might help to hide imperfections in the face 203. Also, the increased uniformity may enable a wall wash type application in which the light fixture 201 is mounted closer to the architectural panel and aimed to output light at a smaller angle between the axis A-A of the fixture output (see FIG. 5) and the architectural panel.

The example of FIGS. 6 to 10 related to increased illumination uniformity across the illuminated area of the face 203 of the architectural panel 205, by decreasing differences in illumination intensity in the various regions of the surface. To emphasize texture of the waves or the like on the surface 204, a similar procedure might increase light directed through light throws 213, 215 and decrease light directed through light throws 217, 219, so as to increase differences in illumination intensity in the various regions of the surface. Also, the examples described relative to FIGS. 6 to 10 addressed only four separately controlled light throws. In actual applications, a fixture 201 or a system like any of those in FIGS. 1 to 3, may offer much finer granularity to control intensity of light outputs from the emitters via a larger number of light throws, particularly if the array is a high-resolution, pixel controllable array.

FIGS. 11 to 14 are flow charts representing several examples of methods of controlling operation of the lighting system to improve or maintain an intended illumination effect on the illuminated area of the face of the architectural panel, when a system like any of those in FIGS. 2 to 4 illuminates a face of an architectural panel.

At a high level, these methods involve illuminating an area of the face of the architectural panel, at an acute angle relative to a plane of the face or otherwise associated with the face, of the architectural panel (e.g. as in FIG. 5); and capturing an image of the illuminated area of the face of the architectural panel via a camera 213 or the like. Regions within the illuminated area of the face having relatively brighter and darker illumination are identified, from processing of data of the captured image. The differences in illumination represented in the image data, for example, may be caused by angled illumination of topological features of the surface of the face of the panel. A method may also involve determining output intensity settings for the emitters of the pixel controllable array to achieve an intended illumination effect (e.g. perceptible uniformity or feature emphasis) on the illuminated area of the face of the architectural panel. The techniques may be utilized to enhance differences in illumination intensity in various regions of the illuminated area of the face of the panel, e.g. to highlight texture or design features, or to provide other types of selectively adaptive illumination. For convenience, the discussions of the example processes of FIGS. 11 to 14, however, generally refer to applications intended for a uniform illumination appearance unless expressly stated otherwise.

The determination of output intensity settings, for example, may compile a lamp correction profile. The method also entails selectively changing output intensity of one or more of the light emitters of the array to change intensity of illumination of one or more of the identified regions and adjust relative intensity of illumination among the regions of the illuminated area of the face of the architectural panel, for example, by selectively changing emitter output intensities in response to the determined output intensity settings in the profile to achieve the intended uniformity or other intended illumination effect on the face of the architectural panel.

The method examples specifically relate to set-up techniques to define lamp correction profiles for use in establishing an intended illumination effect on the illuminated area of the face of the architectural panel. Similar procedures may be developed to use the data of images captured by the camera as feedback in control steps repeated over time, to repetitively adjust the pixel emitter output settings so as to maintain the intended illumination effect on the illuminated area of the face of the architectural panel, e.g. in response to changing conditions of other illumination of the face of the architectural panel by other sources of light or shadow.

A goal of any such procedure directed to achieving apparent uniformity may be to minimize perceptible striations on the illuminated surface area of the face of the architectural panel. The procedures may be configured to reduce differences in intensity across the illuminated area of the panel face, which may provide uniformity or may reduce gradients (rate of change) in intensity. These approaches tend to smooth out the appearance to an observer, e.g. eliminate visible striations.

Figure 11:
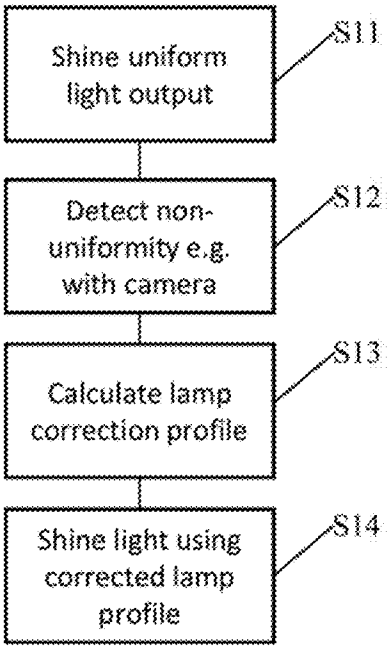

With more specific reference to a first example in FIG. 11, that example method includes a step S11 that involves operating the light fixture 201 to shine emitter outputs of intensities that are substantially uniform over the fixture output aperture. As outlined earlier, FIG. 6 shows such a state in which the light fixture 201 is turned ON but with emitter settings to provide fairly uniform output intensities distributed over the angular distribution range of the fixture output across the area of the face 203 that is to be illuminated, for example, before adaptive control of the pixel controllable array of the solid state emitters. In the method example of FIG. 11, step S12 involves using a camera 213 or other image sensor to obtain image data representing illuminations of the brighter and darker regions in the illuminated area of the face 203 of architectural panel 205 during the illumination with uniform emitter output intensities ala step S11 (see also FIG. 6) and possibly processing of such data to detect illumination non-uniformities. The step S12, for example, may identify locations of regions within the illuminated area of the face of the architectural panel of relatively brighter and darker illumination caused by angled illumination of surface topology features of the face of the architectural panel, from processing of data of the captured image.

Step S13 involves further processing the image data obtained as part of step S12 to calculate intensity settings for the emitters at the pixels of the controllable array to achieve a desired illumination effect on the area of the face of the panel. Calculated settings may be correlated to locations of detected regions within the illuminated area of the face of the architectural panel of relatively brighter and darker illumination. The collection of image settings for the entire array of emitters forms a profile, referred to for convenience as a lamp correction profile. The settings in the profile may be calculated to achieve other effects, but for purposes of an example, the illustrated flow relates to establishing a suitable degree of uniformity (e.g. minimal perceptible striations) across the illuminated area on the face of the architectural panel.

For example, profile formation in S13 may also involve determining output intensity settings for the emitters of the pixel controllable array to achieve the intended illumination effect, for example a desired degree of uniformity, on the illuminated area of the face of the architectural panel. In such an example, the processing in step S13 may calculate new settings to reduce differences in illumination intensity between the previously detected regions of relatively brighter and darker illumination. The resulting lamp correction profile, for example, may specify emitter output intensities, e.g. in steps form 0% (full OFF) to 100% (maximum or full ON), for each of the pixels of the array in fixture 201 to achieve the intended illumination effect on the face 203 of the architectural panel 205.

A variety of algorithms may be used in step S13 to calculate the intensities setting values for inclusion in the lamp correction profile. Iterative procedures and procedures using machine learning are described later with regard to other flow charts. For example, the processor may process the image data to determine locations and degrees of variation in contrast, and adjust the intensity of light output directed to different regions of the illuminated area of the panel face to reduce changes in contrast across the face. Contrast corresponds to slope or gradient of intensity, therefore, rather than necessarily producing actual uniform illumination intensity, achieving contrast uniformity may only require that changes in slope or gradient of intensity are sufficiently small. The illumination is sufficiently uniform when the changes in contrast are sufficiently low as to be imperceptible by a human observer.

Figure 14:
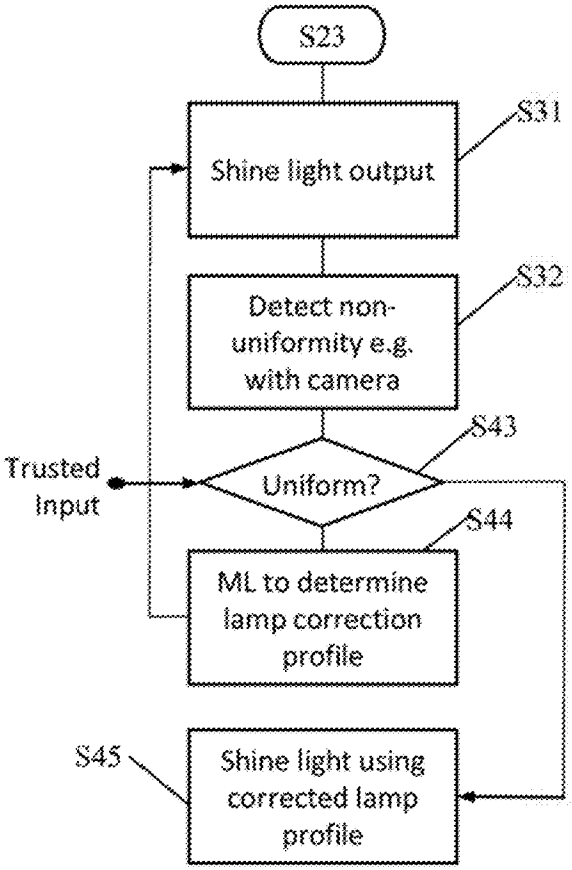
Figure 15:
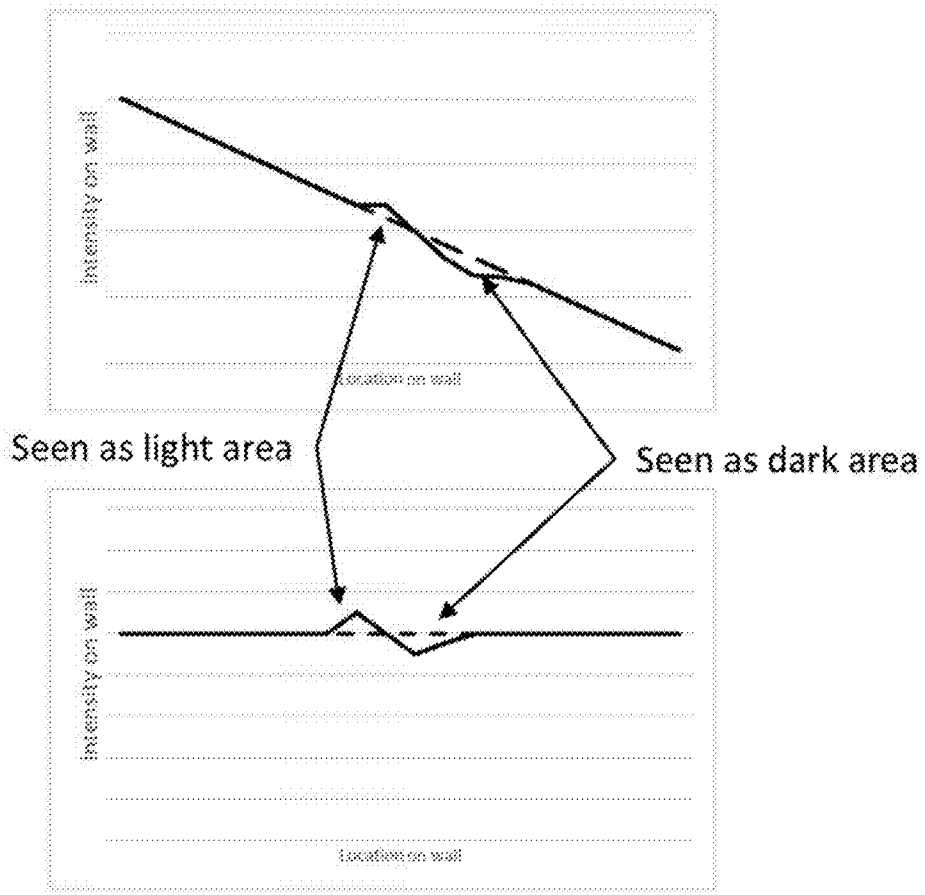
FIG. 15 is an overlay of two stylized graphs of light illumination intensity versus location of light on an illuminated face of a wall type panel, useful in understanding concepts discussed relative to the process flows of FIGS. 11 to 14.

FIG. 15 shows two stylized graphs of observable illumination intensity versus location of light on an illuminated face of a wall type panel, useful in understanding concepts discussed relative to the process flows of FIGS. 11 to 14. The zig-zag deviation in each graph represents a change in slope or gradient in observable illumination on the face. Although each graph shows a zig-zag and only one zig-zag section of such variation, there may be other types of deviations and/or many more deviations.

The lower graph represents a relatively uniform intensity versus location of light on the illuminated area of the face, as represented by a relatively horizontal line (zero slope). Where the slope is fairly constant, a person would see the illumination as uniform. For discussion purposes, the illustration includes a zig-zag in the line. The sudden deviation from the slope creates perceptible striation. Where the deviation is a sudden increase above the horizontally sloped line, the observer would perceive a brighter illumination. Where the deviation is a sudden decrease below the horizontally sloped line, the observer would perceive a darker area (darker illumination striation).

The upper graph represents observable illumination intensity that changes linearly with location of light on the illuminated area of the face, as represented by way of example by a decreasing line of relatively constant slope (e.g. lower actual intensity further away from the light fixture). Where the slope is fairly constant, a person still may perceive the illumination as uniform. For discussion purposes, the illustration includes a zig-zag in the upper line. The sudden deviation from the slope creates perceptible striation. Where the deviation is a sudden increase above the downwardly sloped line, the observer may perceive a brighter illumination. Where the deviation is a sudden decrease below the downwardly sloped line, the observer may perceive a darker area (darker illumination striation).

A simple algorithm example might calculate an average slope of illumination intensity across the illuminated area, based on data of the captured image for that area. Then, the algorithm might select emitters corresponding to light regions and dark regions and adjust the respective intensity settings from emitters down or up from the average slope setting, by an amount selected so that each emitter provides approximately the average slope of illumination intensity at the angled region of the face where light from the respective emitter illuminates the surface.

Subsequently, step S14 implements the selective control of output intensity of one or more of the light emitters of the array, for example, to change intensity of illumination of one or more of the identified regions (in the example, as a change from the intensities in the uniform appearance state of S11) so as to adjust relative intensity of illumination among the regions of the illuminated area of the face of the architectural panel. In the example flow using the lamp correction profile, the system (e.g. from any of FIGS. 2 to 4) controls the driver to shine light from the emitters of the array using the setting values defined in the corrected lamp profile obtained in step S13. The settings enable the array output light, as distributed through the optic, to vary the illumination across the area of the face 203 so as to achieve (within a suitable tolerance) the intended illumination effect.

Figure 12:
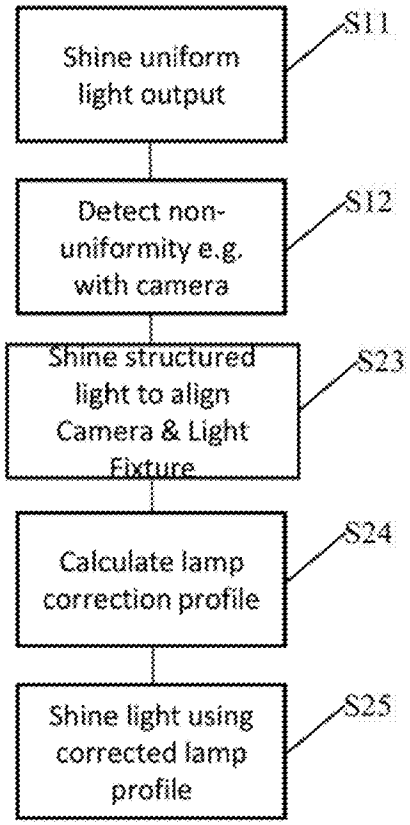
FIGS. 11 to 14 are flow charts representing several examples of methods of controlling operation of the lighting system to provide an intended illumination effect when the system illuminates a face of an architectural panel.

The method example of FIG. 12 involves shining uniform outputs from the emitters at the pixels of the controllable array to illuminate the area of the face of the panel and capturing an image of non-uniformly illuminated regions (bright and dark regions) via a camera or the like, essentially the same as in steps S11 and S12 of the method of FIG. 11.

In the example of FIG. 12, the method includes a step S23 of operating the emitters of the pixel controllable array of the light fixture 201 to shine a structured light over the area of the face 203 that is to be illuminated. The structured light is a light distribution of known output intensities emitted in different directions from the light fixture, to calibrate the camera relative to the light fixture and/or the face 203 of the architectural panel 205. The structured light output, for example, may produce one or more light or dark regions each having a predetermined shape/location on the face 203. Although not shown as a separate step, the camera 213 or other image sensor is operated again to obtain image data representing illuminations of the brighter and darker regions in the illuminated area of the face 203 of architectural panel 205 during illumination with the known structured light output.

Other techniques may be used to structure light emissions for use in the alignment or calibration step S23. For example, the structured light emission might involve cycling through and driving the pixel emitters at the same (uniform slope) set intensity (e.g. each full ON, or each 75% of full ON, or the like) one at a time or by rows and columns and capturing successive images in the different structured emission states of the output light from the fixture 201 on the face 203 of architectural panel 205. In this approach, the image processing would identify emitters for correlation with illuminated locations on the face of the architectural panel based by correlating emission times of the emitters with detected illumination timing via the camera images. In another approach to structured light emission, the pixel emitter outputs may be individually modulated, e.g. pulse width modulated with codes or the like, for use in identifying an illuminated region on the face of the panel exhibiting the code/modulation with the particular emitter that produced the respective modulated light output. The code/modulation approach provides a form of multiplexing that enables detection of illumination on the surface from some number of the emitters during each cycle of capturing one or more images sufficient in number to detect the code/modulation.

With these or other structured light emission strategies, the data of one or more images of the illumination of the face 203 with the structured light is processed to determine the relationship between light outputs from emitters at pixels in the array and locations of regions of the illuminated area of the face 203 of the architectural panel when illuminated by the emissions from the respective pixel emitters through the optic.

The order of the steps is shown by way of example only. For example, the uniform illumination and image detection in steps S11, S12 may follow the structured illumination, image data processing and calibration in step S13.

Once calibrated, step S24 involves processing the image data obtained in step S22 and the correlation of the pixel emitters of the array to locations of illumination from the emitters on the illuminated area of the face 203 in step S23, to calculate intensity setting values for a lamp correction profile corresponding to a desired surface illumination effect. In the example, the intended effect is a relatively high degree of uniformity, although other effects may be achieved, such as a particular degree of intended shadow effects to show desired textures. The lamp correction profile would specify output intensities, e.g. in steps form 0% (full OFF) to 100% (maximum or full ON), for each of the pixels of the array in fixture 201 to achieve the desired illumination effect on the face 203 of the architectural panel 205. The setting adjustments for the various pixel emitters of the array may be calculated at S24 in a manner similar to examples discussed above relative to step S13 of FIG. 11.

Step S25 then involves applying the lamp correction profiled to drive the emitters of the pixel controllable array of the light fixture, according to the setting values, so as to illuminate the face 203 of the architectural panel 205, including the surface topological features of the face 203. The settings enable the array output light, as distributed through the optic, to vary the illumination across the area of the face 203 so as to achieve (within a suitable tolerance) the intended illumination effect.

Once calibrated and if configured with profiles or other forms of setting data defining some number of target or predefined variations in illumination effects, dynamic control, for example, may allow a user to select or 'dial' between a uniform illumination setting that gives a visual appearance of a flat non-textured surface (analogous to a wall washing application) and an illumination pattern that emphasizes the light and dark regions of the panel face created by the surface topological features (analogous to a wall grazing of a textured wall or the like). If the camera is available to provide feedback during operations of the fixture, the system may process image data from the camera to further adjust the correction profile and thus the output light distribution to maintain a setting for a desired illumination effect, e.g. using the camera and associated data processing as a feedback loop to maintain uniformity or maintained desired lighting of textural features.

Figure 13:
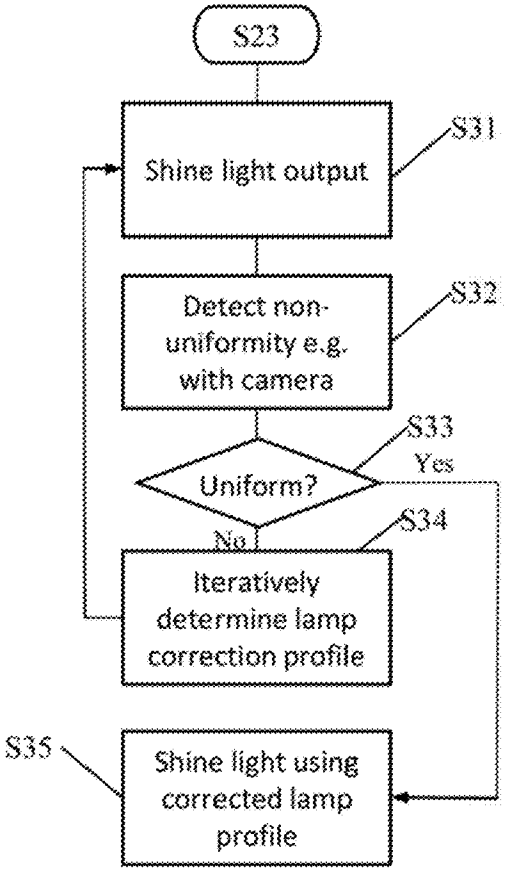

As noted, a method like that of FIG. 12 may have similar steps implemented in different orders. In the example of FIG. 13, a step S23 is implemented first. As in the example of processes flow in FIG. 12, step S23 involves operating the emitters of the pixel controllable array of the light fixture 201 to shine a structured light over the area of the face 203 and processing the data of one or more images of the illuminated area to determine the relationship between emitters in the array to locations of regions of the illuminated area illuminated by the respective pixel emitters. Once the system is calibrated, the method example of FIG. 13 then includes steps of shining light output on the face of the panel (S31) and capturing an image of non-uniformly illuminated regions face of the panel via a camera or the like (S32).

The example of FIG. 13 involves an iterative processing loop. In a first pass, after calibration/alignment in step S23, the step S31 shines uniform outputs from the emitters at the pixels of the controllable array to illuminate the area of the face of the panel; and step S32 captures an image of non-uniformly illuminated regions (bright and dark regions) of the face of the panel via a camera or the like for detection of non-uniformities of illumination, essentially the same as in steps S11 and S12 of the methods of FIGS. 11 and 12. As discussed more later, in each subsequent pass, the step S31 shines adjusted outputs from the emitters at the pixels of the controllable array based on a newly calculated lamp correction profile to illuminate the area of the face of the panel; and step S32 captures a new image of illuminated area of the face of the architectural panel.

The example of FIG. 13 implements an iterative light emission output and adjustment with the camera providing feedback, through a loop formed by steps S31, S32, S33 and S34 in the simple example. In each iteration of the loop, step S33 analyzes parameters of the non-uniformities of illumination detected and checks whether the result is sufficiently uniform, within specified tolerance. The analysis, for example may involve generating statistics and determining if one or more statistical parameters satisfy one or more thresholds. For example, a processor may determine an average slope intensity of illumination across the surface from data of an image of the illuminated surface of the face of the architectural panel and then determine a deviation of slope of intensity versus location, for each pixel of image data from the overall average slope. With this example, the illumination is sufficiently uniform, if the deviation in slope at any one pixel of image data from the overall average slope is no more than a threshold, which may be defined by the contrast sensitivity function.

Hence, in each iteration of the loop, step S33 analyzes illumination intensity data obtained from the image captured by the camera in step S32 to determine if the distributed light outputs from the array via the optic provide suitably uniform illumination of the face of the panel. If not, then processing branches from S33 to step S34. The processing in step S34 calculates new intensity setting values for the emitters at the pixels of the controllable array to form a lamp correction profile. If a non-imaging optic is used, it may be helpful to utilize an optimization algorithm to correlate changes in the output intensities of the emitters of the array to contrast in the illumination of the surface so as to minimize perceptible striations. An example optimization algorithm is a genetic algorithm.

In the iterative process example of FIG. 13, the calculation in each pass regarding intensity may be fairly simple. For example, for a pixel that correlates to part of a detected brighter region, the process may decrease the intensity setting for the corresponding light emitter by a small set value (e.g. by 5% of maximum output intensity); and, for each pixel that correlates to part of a detected darker region, the process may increase the intensity setting for the corresponding light emitter by a small set value (e.g. by 5% of maximum output intensity), so as to minimize variations in contrast (e.g. variation in slope or gradient of the intensity versus illumination graph). Settings for some emitters may not change, e.g. if the detected illumination intensity of a region illuminated by such a pixel meets a set criteria, e.g. slope is within a threshold difference from an intensity slope parameter. On a first pass after uniform intensity emissions from all emitters of the array, the changes in settings would be from the initial uniform output intensity settings. On each subsequent pass through the loop, any changes in intensity settings for emitters aimed at regions sufficiently brighter or darker than a target value (e.g. an average slope of illumination intensity) would be changed by the appropriate set amounts relative to output intensity settings used in the immediately preceding pass through the processing loop.

After each execution of the profile calculation in step S34, the process flow returns to step S31. The step S31 shines the output light based on the latest iteration of the lamp correction profile in step S34. Then, the steps S32 and S33 are repeated to capture an image, process the data of the image detect any remaining non-uniformity of illumination on the surface area of the face, and determine from analysis of the image data if the illumination is now sufficiently uniform.

The iterative process would repeat with adjustments to the lamp correction profile until a profile is determined that achieves a desired degree of perceptible uniformity of illumination across the illuminated area of the face 203, as determined at step S33. For example, the system might repeat the iterative processing until all regions of the illumination area appear to have substantially the same illumination intensity in the image captured by the camera and/or except contrast (slope or gradient of intensity variation), within a defined level of tolerance not readily apparent to a human observer.

FIG. 14 shows another example of a processing flow similar to the procedure of FIG. 13. Steps S23, S31 and S32 are essentially the same as in the example of FIG. 13. Steps S31, S32, S43 and S44 form a processing loop, except that in the procedure of FIG. 14, steps implement machine learning. Although the determination of adequacy of uniformity in step S43 may analyze similar statistics as utilized in step S33, the decision in step S44 is at least partially based on a trusted user input. In general, a machine learning algorithm, such as a neural network, "learns" how to manipulate various inputs, possibly including previously generated outputs, in order to generate current new outputs. As part of this learning process, the algorithm receives feedback on prior outputs (e.g. the trusted input) and possibly some other inputs. Then, the neural network or the like calculates weights to be associated with the various inputs (e.g. the previous outputs, feedback, etc.). The weights are then utilized by the neural network to manipulate the inputs and generate the current outputs intended to improve some aspect of system performance in a desired manner. For machine learning, training data is the discrepancy between the outputs of a present system and the outputs of a trusted system. In the example of FIG. 14, when not yet sufficiently uniform at S43, the determination of an updated lamp correction profile in step S44 uses the statistics and/or the trusted user input as values in a neural network or other machine learning (ML) algorithm, to calculate and adjust the setting values according to weighting values to produce the values for each lamp correction profile.

The machine learning based processing loop would repeat with adjustments to the lamp correction profile until a profile is determined that achieves a desired degree of perceptible uniformity of illumination across the illuminated area of the face 203, as determined at step S43. For example, the system might repeat the machine learning processing until all regions of the illumination area appear to have substantially the same illumination intensity and/or minimal variations in contrast in the image captured by the camera, within a defined level of tolerance not readily apparent to a human observer, similar to the tolerance(s) discussed above in the example of FIG. 13.

The image analysis and processing to calculate intensity settings values for a profile in the examples of FIGS. 11 to 14 may be implemented via various hardware in a system like that of FIG. 4 and/or in a computer system communicating via a network with such a system. The camera can be a digital camera of an appropriate sensitivity to detect the light and dark regions and intensities in the digital data of one or more captured images coupled to communicate with a computer or with the host processing system 115. The processing analysis of image data and setting computations for a lamp correction profile may be done in the processor of the lighting system (see FIG. 4). For more complicated algorithms, however, such as using machine learning and/or iterative deviation analysis, the processing to develop a lamp correction profile may be done in a remote processor having higher data processing capabilities and/or access to more data storage. In the later type of processing implementation, each resulting correction profile for a different intended illumination effect would be downloaded and stored in memory of the host processing system (see FIG. 4). Depending on memory capacity and desired functionality of the particular illumination system, the memory, may store one, two, three or more lamp correction profiles to use at different times or under different circumstances.

The image data relating to non-uniform surface illumination provides a logical 'map' of light and dark areas and relative differences in detected intensity as the face of the panel is illuminated. With a uniform intensity light output distribution from the fixture, the intensity distribution 'map' in the image data relates closely to the angled illumination from the fixture impacting of the surface topological features of the particular illuminated face/panel. Although not necessarily used for illumination control, the image data may be processed to form a contour map of the features of the illuminated area of the face of the panel.

For convenience, the illustrated examples and description thereof have generally assumed a relatively static surface (e.g. the contour of the face and/or configuration of the surface topology features of the face of the architectural panel do not change over time, although the ambient lighting thereof may change). The adaptive illumination light fixtures and the methods of illumination, however, may be readily adapted to a panel and/or face that changes over time. A face of an outdoor panel, for example, may change over time due to a buildup of some kind of material on the face, e.g. due to falling rain, snow or the like, or due to pollutants from other repeated precipitation events or from air-borne contaminants. The feedback using a camera, in such an example, may enable adjustment of the outputs of the emitters at the points of the array to maintain the desired illumination effect while adjusting for the buildup at different locations on the illuminated area of the face. Changes in outputs of the array may also compensate for changes in reflectivity of the face of the panel, e.g. due to dirt or the like. By way of another dynamic control example for a potentially changeable panel, an architectural panel may include a door. If the door opens, the processing of the image data from the camera may be capable of detecting that changed condition and adjusting the output of light from the pixel controllable array of solid state light emitters through the optic, e.g. to reduce glare by dimming the light delivered to the area of the open door.

The illustrations for the examples discussed in detail above related to panels with faces having relatively flat macro-contours, such as walls, ceilings, floors or countertops. Such flat contoured panels have a flat plane PL associated with the face 203 of the architectural wall/panel 205 (see FIG. 5). The systems and methods disclosed herein, however, may be adapted to illumination of panels with contours of other non-flat types. If the face is not a flat contoured surface, for example, if the face has a curved or faceted large scale (macro) surface contour, then the face would have associated tangential planes at the various points of the intended or ideal contour of the face of the panel.

Figure 16:
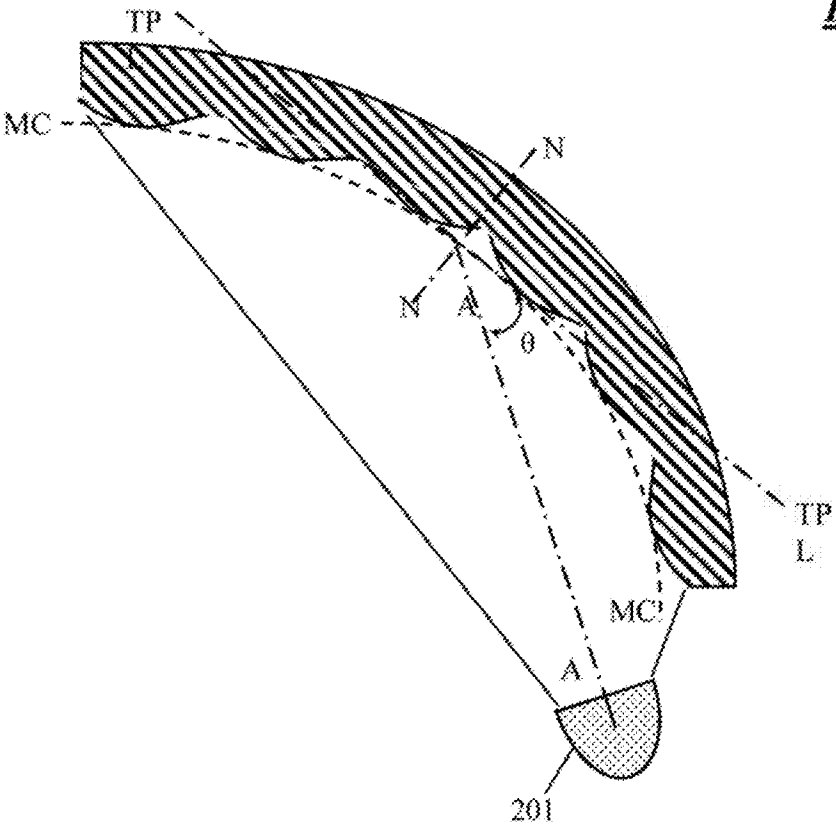
FIG. 16 is a somewhat exaggerated, enlarged illustration of an angled illumination of a face of an architectural panel, using a light fixture of the type described herein, where the panel and face have curved contours.

It may be helpful to consider a few curved contour examples, with respect to FIGS. 16 to 19. In those drawings, the half oval shape is a convenient symbol (only, and not limiting) for a light fixture 201 that includes the combination of a pixel controllable array of solid state emitters and a suitable optic, as described relative to FIGS. 2 to 4. FIG. 16 shows the fixture 201 and the curved panel in side or cross-section, but with the fixture turned OFF.

FIG. 16 illustrates an arrangement for angled illumination of a face of an architectural panel, using a light fixture 21 to illuminate the face having a curved contour. The drawing is a somewhat exaggerated, enlarged illustration, for ease of viewing by the reader. A real curved panel, for example, would likely have proportionally smaller features. The light fixture 201 provides angled illumination of the curved face of an architectural panel, for example, around the optical output axis A-A, as in the earlier flat example.

The curved face of the panel has macro-contour MC corresponding to an intended or ideal shape for the curved panel face. The curve of the MC may correspond to minima, maxima or an average height of the features. In the example, the macro-contour MC corresponds to the points at the maximum distances from the opposite surface of the panel. The curvature may be three-dimensional, although the drawing only shows a two-dimensional curvature of MC, in the side or cross-sectional view.

A curved contour such as MC will have associated tangential planes associated with various points on the curve. In the illustration, the line at TPL-TPL represents the tangential plane relative to MC, that touches the curve of MC at the point where the light fixture output axis A-A intersects contour MC. The line/plane N-N is normal to MC and TPL where the axis A-A intersects MC.

The light fixture 201 is aimed so that its optical output axis A-A is oriented at an acute angle θ relative to the tangential plane TPL-TPL of the face of the curved architectural panel. The surface(s) of the face in this example forms a number (one or more) of surface topological features, generally similar to the wave shown in the earlier example of FIGS. 5 to 10, although the features may have other shapes, sizes and numbers. The curved architectural panel may be a portion of a dome, a portion of a vaulted ceiling, or the like.

For convenience, the surface topological features are shown in somewhat exaggerated enlarged form. The surface topological features may be raised or lowered from the average of the MC curve of the face of the panel. Such features may be imperfections or may be deliberately provided as a texture or the like for the surface. Features may have a variety of shapes and sizes.

In a situation where the wall is not flat, an active grazing light output or an active wall wash light can still be used. The same results would still be desirable and may be controlled as in the earlier processing examples.

Figure 17:
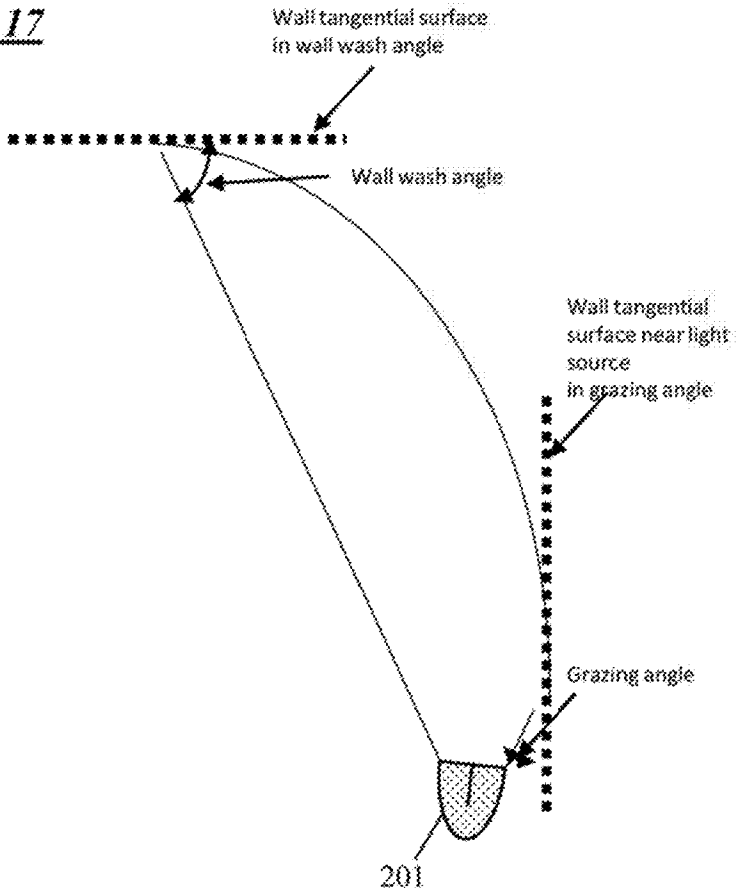
FIGS. 17 to 19 are illustrations of illumination of different types of curved architectural panel faces, each using a light fixture of the type described herein.
Figure 19:
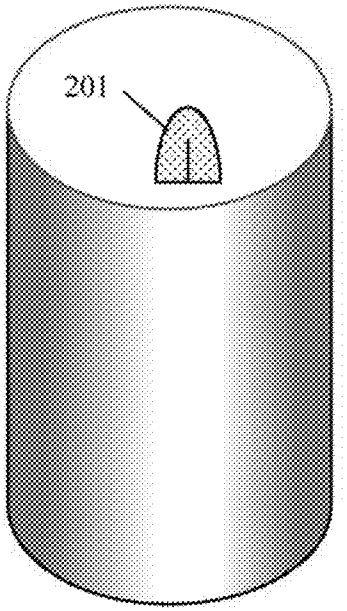
Figure 18:
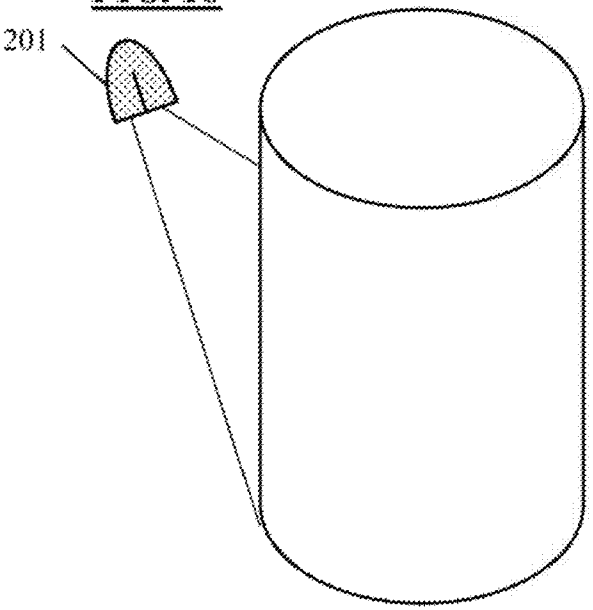

FIGS. 17 to 19 are illustrations of illumination of different types of curved architectural panel faces, each using a light fixture of the type described herein. FIG. 17 shows a curve similar to the curve MC of FIG. 16, but at a scale in which small features are not readily apparent. This drawing also illustrates a transition from grazing angle for light output on one side of the fixture 201 near a wall, to a region with the light on a portion of the face has a wall wash angle (albeit on a horizontal part of the panel such as a ceiling) where the light output from the opposite side of the fixture 201 is directed to a horizontal part of the panel face.

FIGS. 18 and 19 show use of the light fixture 201 to adaptively illuminate a curved exterior surface of a pillar. FIG. 18 shows a light fixture aimed tangentially toward a vertical line of the relatively cylindrical macro-contour of the pillar. This alignment, for example, may be utilized to correct lighting for imperfections of the surface of the pillar. FIG. 19 shows a lighting fixture aimed from above at an acute angle relative to a vertical line along the relatively cylindrical macro-contour of the pillar. This alignment, for example, may be utilized to adjust for the inherent aspect ratios of brightness differences. For example, the vertical line near the light source is bright and fades away as it goes around the circumference of the pillar; and this can be corrected by distributing less light on the vertical line and more around the circumference.

Figure 20:
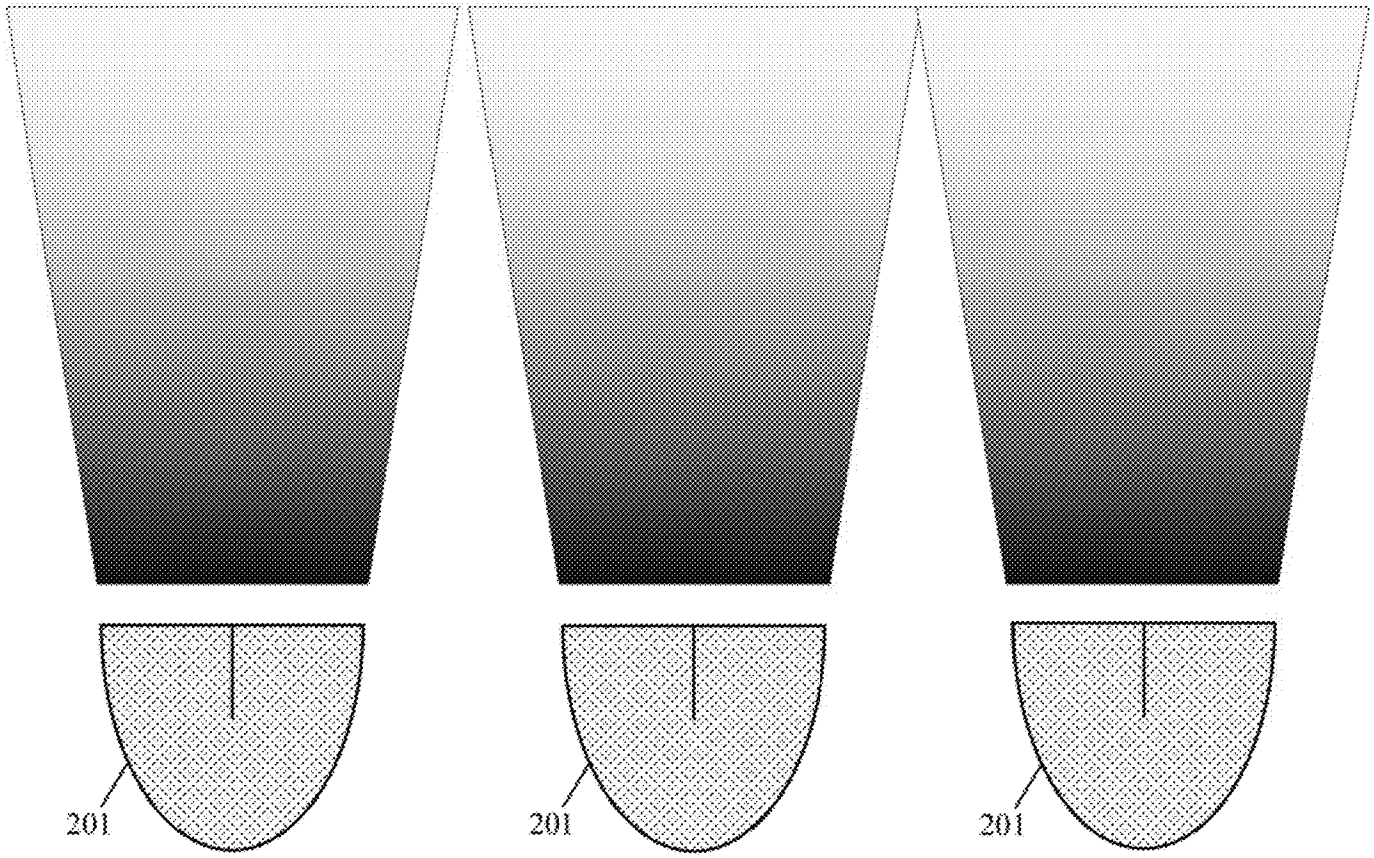
FIG. 20 shows adaptive illumination of a face using several of the light fixtures of the type described herein controlled to provide specified illumination distributions on the illuminated face, e.g. somewhat scalloped distributions along the architectural panel.

FIG. 20 shows adaptive illumination of a face using several of the light fixtures of the type described herein. Each individual light fixture 201 may be controlled independently, to provide different adjustments in intensities as in earlier examples and/or to provide specified illumination distributions on respective illuminated areas of the face. Although the fixtures may provide other distribution shapes, the example illustration represents somewhat trapezoidal, scalloped distributions along the architectural panel, as might be provided for a particular scalloped lighting aesthetic that also offers wall wash or wall grazing of the face of the panel.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," "includes," "including," or any other variation thereof, are intended to cover a non-exclusive inclusion, such that a process, method, article, or apparatus that comprises or includes a list of elements or steps does not include only those elements or steps but may include other elements or steps not expressly listed or inherent to such process, method, article, or apparatus. An element preceded by "a" or "an" does not, without further constraints, preclude the existence of additional identical elements in the process, method, article, or apparatus that comprises the element.

Unless otherwise stated, any and all measurements, values, ratings, positions, magnitudes, sizes, and other specifications that are set forth in this specification, including in the claims that follow, are approximate, not exact. Such amounts are intended to have a reasonable range that is consistent with the functions to which they relate and with what is customary in the art to which they pertain. For example, unless expressly stated otherwise, a parameter value or the like may vary by as much as ±10% from the stated amount.

In addition, in the foregoing Detailed Description, it can be seen that various features are grouped together in various examples for the purpose of streamlining the disclosure. This method of disclosure is not to be interpreted as reflecting an intention that the claimed examples require more features than are expressly recited in each claim. Rather, as the following claims reflect, the subject matter to be protected lies in less than all features of any single disclosed example. Thus the following claims are hereby incorporated into the Detailed Description, with each claim standing on its own as a separately claimed subject matter.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present concepts.

What is claimed is:

1. A method of illuminating a face of an architectural panel, comprising steps of:

directing light output from a pixel controllable array of solid state light emitters to illuminate an area of the face of the architectural panel, at an acute angle relative to the face of the architectural panel;

capturing an image of the illuminated area of the face of the architectural panel;

identifying regions within the illuminated area of the face of the architectural panel of relatively brighter and darker illumination caused by angled illumination of surface topology features of the face of the architectural panel, from processing of data of the captured image;

selectively changing output intensity of one or more of the light emitters of the array to change intensity of illumination of one or more of the identified regions and adjust relative intensity of illumination among the regions of the illuminated area of the face of the architectural panel; and repeating the steps of capturing, identifying and selectively changing output intensity to improve or maintain an intended illumination effect on the illuminated area of the face of the architectural panel, wherein the repetition of the steps implements feedback to maintain the intended illumination effect on the illuminated area of the face of the architectural panel.

2. The method of claim 1, wherein the adjustment of relative intensity of illumination among the regions of the illuminated area of the face of the architectural panel reduces differences of intensity of illumination among the regions.

3. The method of claim 1, wherein the adjustment of relative intensity of illumination among the regions of the illuminated area of the face of the architectural panel increases differences of intensity of illumination among the regions.

4. A method of illuminating a face of an architectural panel, comprising steps of:

directing light output from a pixel controllable array of solid state light emitters to illuminate an area of the face of the architectural panel, at an acute angle relative to the face of the architectural panel;

capturing an image of the illuminated area of the face of the architectural panel;

identifying regions within the illuminated area of the face of the architectural panel of relatively brighter and darker illumination caused by angled illumination of surface topology features of the face of the architectural panel, from processing of data of the captured image;

selectively changing output intensity of one or more of the light emitters of the array to change intensity of illumination of one or more of the identified regions and adjust relative intensity of illumination among the regions of the illuminated area of the face of the architectural panel; and repeating the steps of capturing, identifying and selectively changing output intensity to improve or maintain an intended illumination effect on the illuminated area of the face of the architectural panel, wherein the repetition of the steps implements an iterative procedure to determine output intensity settings of emitters of the pixel controllable array to implement the intended illumination effect on the illuminated area of the face of the architectural panel.

5. A method of illuminating a face of an architectural panel, comprising steps of:

directing light output from a pixel controllable array of solid state light emitters to illuminate an area of the face of the architectural panel, at an acute angle relative to the face of the architectural panel;

capturing an image of the illuminated area of the face of the architectural panel;

identifying regions within the illuminated area of the face of the architectural panel of relatively brighter and darker illumination caused by angled illumination of surface topology features of the face of the architectural panel, from processing of data of the captured image;

selectively changing output intensity of one or more of the light emitters of the array to change intensity of illumination of one or more of the identified regions and adjust relative intensity of illumination among the regions of the illuminated area of the face of the architectural panel; and repeating the steps of capturing, identifying and selectively changing output intensity to improve or maintain an intended illumination effect on the illuminated area of the face of the architectural panel, wherein the repetition of the steps implements a machine learning procedure to determine output intensity settings of emitters of the pixel controllable array to implement the intended illumination effect on the illuminated area of the face of the architectural panel.

6. A method of illuminating a face of an architectural panel, comprising steps of:

directing light output from a pixel controllable array of solid state light emitters to illuminate an area of the face of the architectural panel, at an acute angle relative to the face of the architectural panel;

capturing an image of the illuminated area of the face of the architectural panel;

identifying regions within the illuminated area of the face of the architectural panel of relatively brighter and darker illumination caused by angled illumination of surface topology features of the face of the architectural panel, from processing of data of the captured image; and selectively changing output intensity of one or more of the light emitters of the array to change intensity of illumination of one or more of the identified regions and adjust relative intensity of illumination among the regions of the illuminated area of the face of the architectural panel, wherein:

the step of identifying includes a step of determining output intensity settings for the emitters of the pixel controllable array to achieve an intended illumination effect on the illuminated area of the face of the architectural panel; and the step of selectively changing output intensity is responsive to the determined output intensity settings for the emitters of the pixel controllable array.

7. A method of illuminating a face of an architectural panel, comprising steps of:

directing light output from a pixel controllable array of solid state light emitters to illuminate an area of the face of the architectural panel, at an acute angle relative to the face of the architectural panel;

capturing an image of the illuminated area of the face of the architectural panel;

identifying regions within the illuminated area of the face of the architectural panel of relatively brighter and darker illumination caused by angled illumination of surface topology features of the face of the architectural panel, from processing of data of the captured image; and selectively changing output intensity of one or more of the light emitters of the array to change intensity of illumination of one or more of the identified regions and adjust relative intensity of illumination among the regions of the illuminated area of the face of the architectural panel, wherein:

the face of the architectural panel has a contour that is at least somewhat flat;

the light output has an axis; and the light output axis is at an acute angle with respect to a plane of the contour of the face of the architectural panel.

8. A method of illuminating a face of an architectural panel, comprising steps of:

directing light output from a pixel controllable array of solid state light emitters to illuminate an area of the face of the architectural panel, at an acute angle relative to the face of the architectural panel;

capturing an image of the illuminated area of the face of the architectural panel;

identifying regions within the illuminated area of the face of the architectural panel of relatively brighter and darker illumination caused by angled illumination of surface topology features of the face of the architectural panel, from processing of data of the captured image; and selectively changing output intensity of one or more of the light emitters of the array to change intensity of illumination of one or more of the identified regions and adjust relative intensity of illumination among the regions of the illuminated area of the face of the architectural panel, wherein:

the face of the architectural panel has a non-flat contour;

the light output has an axis; and the light output axis is at an acute angle with respect to a plane tangential to the non-flat contour of the face of the architectural panel.

9. The method of claim 8, wherein the adjustment of relative intensity of illumination among the regions of the illuminated area of the face of the architectural panel reduces differences of intensity of illumination among the regions.

10. The method of claim 8, wherein the adjustment of relative intensity of illumination among the regions of the illuminated area of the face of the architectural panel increases differences of intensity of illumination among the regions.

11. The method of claim 4, wherein the adjustment of relative intensity of illumination among the regions of the illuminated area of the face of the architectural panel reduces differences of intensity of illumination among the regions.

12. The method of claim 4, wherein the adjustment of relative intensity of illumination among the regions of the illuminated area of the face of the architectural panel increases differences of intensity of illumination among the regions.

13. The method of claim 5, wherein the adjustment of relative intensity of illumination among the regions of the illuminated area of the face of the architectural panel reduces differences of intensity of illumination among the regions.

14. The method of claim 5, wherein the adjustment of relative intensity of illumination among the regions of the illuminated area of the face of the architectural panel increases differences of intensity of illumination among the regions.

15. The method of claim 6, wherein the adjustment of relative intensity of illumination among the regions of the illuminated area of the face of the architectural panel reduces differences of intensity of illumination among the regions.

16. The method of claim 6, wherein the adjustment of relative intensity of illumination among the regions of the illuminated area of the face of the architectural panel increases differences of intensity of illumination among the regions.

17. The method of claim 7, wherein the adjustment of relative intensity of illumination among the regions of the illuminated area of the face of the architectural panel reduces differences of intensity of illumination among the regions.

18. The method of claim 7, wherein the adjustment of relative intensity of illumination among the regions of the illuminated area of the face of the architectural panel increases differences of intensity of illumination among the regions.

* * * * *